US008730216B2

(12) United States Patent
Mizutani et al.

(10) Patent No.: US 8,730,216 B2
(45) Date of Patent: May 20, 2014

(54) DISPLAY MEDIUM DRIVE DEVICE, COMPUTER-READABLE STORAGE MEDIUM, AND DISPLAY DEVICE

(75) Inventors: Ryota Mizutani, Kanagawa (JP); Yoshinori Machida, Kanagawa (JP); Yasufumi Suwabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 162 days.

(21) Appl. No.: 13/305,215

(22) Filed: Nov. 28, 2011

(65) Prior Publication Data

US 2012/0139966 A1 Jun. 7, 2012

(30) Foreign Application Priority Data

Dec. 1, 2010 (JP) ..... 2010-268741
Jun. 23, 2011 (JP) ..... 2011-139474

(51) Int. Cl.
*G09G 5/10* (2006.01)

(52) U.S. Cl.
USPC ..... 345/204; 345/107

(58) Field of Classification Search
USPC ..... 345/107, 85, 95, 105, 204; 359/296
See application file for complete search history.

(56) References Cited

U.S. PATENT DOCUMENTS 7,518,782 B2 * 4/2009 Maeda ..... 359/296
7,705,823 B2 * 4/2010 Nihei et al. ..... 345/107
2008/0117165 A1 * 5/2008 Machida et al. ..... 345/107

FOREIGN PATENT DOCUMENTS

JP A-2005-115066 4/2005
JP A-2008-129179 6/2008

* cited by examiner

*Primary Examiner* — Andrew Sasinowski
(74) *Attorney, Agent, or Firm* — Oliff PLC

(57) ABSTRACT

A display medium drive device includes: a translucent display medium, a back substrate opposing the display substrate, a dispersant sealed between the display substrate and the back substrate, and plural types of particle groups with different colors and charge polarities that are dispersed in the dispersant so as to move in the inter-substrate space in response to an electric field; and a voltage application unit which, in a case of displaying a gradation of a color of a first particle group, applies a first voltage and which is a voltage equal to or greater than a threshold voltage needed to cause at least some of the first particle group to detach from the display substrate or the back substrate and thereafter applies a second voltage that has the same polarity as the first voltage and is lower than the threshold voltage.

6 Claims, 20 Drawing Sheets

DISPLAY MEDIUM DRIVE DEVICE, COMPUTER-READABLE STORAGE MEDIUM, AND DISPLAY DEVICE

CROSS-REFERENCE TO RELATED APPLICATION

This application is based on and claims priority under 35 USC 119 from Japanese Patent Application No. 2010-268741 filed on Dec. 1, 2010 and Japanese Patent Application No. 2011-139474 filed on Jun. 23, 2011.

BACKGROUND

1. Technical Field

The present invention relates to a display medium drive device, a computer-readable storage medium storing a drive program, and a display device.

2. Related Art

There is a known technology for a display medium in which particles are sealed between a pair of electrodes and is made to move between the electrodes by voltage being applied thereon.

SUMMARY

A drive device pertaining to one aspect of the present invention includes: a display medium that has a translucent display substrate, a back substrate that is placed opposing the display substrate across a gap, a dispersant that is sealed in an inter-substrate space between the display substrate and the back substrate, and plural types of particle groups with different colors and charge polarities that are dispersed in the dispersant and are sealed in the inter-substrate space so as to move in the inter-substrate space in response to an electric field formed in the inter-substrate space; and a voltage application unit which, in a case of displaying a gradation of a color of a first particle group of the plural types of particle groups, applies to the inter-substrate space a first voltage according to the gradation of the color of the first particle group and which is a voltage equal to or greater than a threshold voltage needed to cause at least some of the particles of the first particle group to detach from the display substrate or the back substrate and thereafter applies a second voltage that has the same polarity as the first voltage and is lower than the threshold voltage.

BRIEF DESCRIPTION OF THE DRAWINGS

Exemplary embodiments of the present invention will be described in detail based on the following figures, wherein.

DETAILED DESCRIPTION

The same reference signs will be given throughout all of the drawings to members whose action and functions bear the same work, and redundant description of those members may be omitted. Further, in order to simply description, exemplary embodiments will be described using drawings appropriately focused on one cell.

Further, cyan particles will be called cyan particles C, magenta particles will be called magenta particles M, yellow particles will be called yellow particles Y, and each particle and their particle groups will be indicated by the same symbols (signs).

First Exemplary Embodiment

Figure 1A:
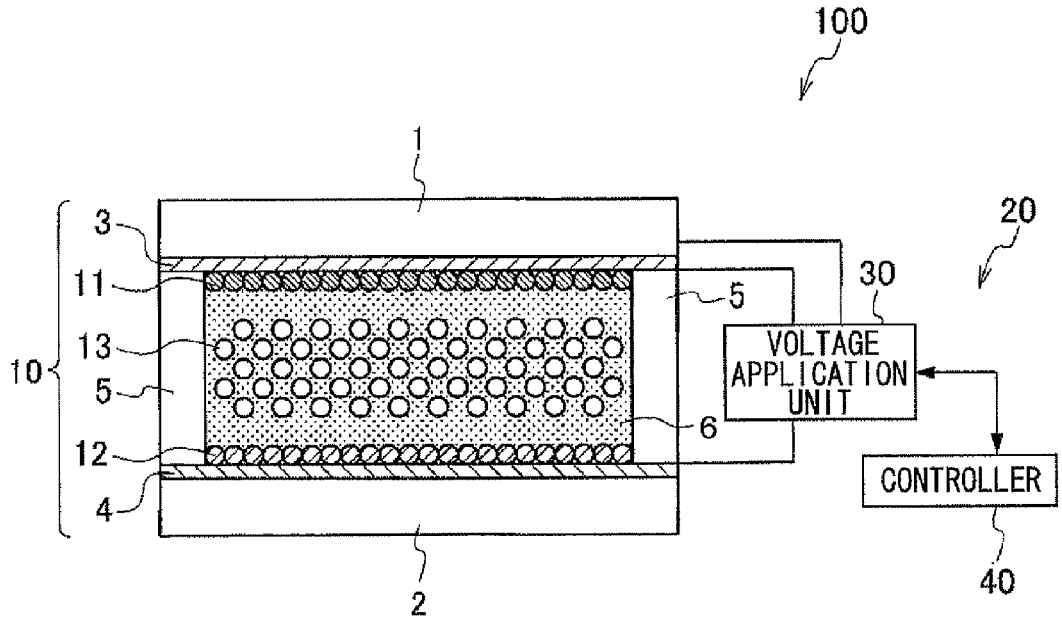
FIGS. 1A and 1B are schematic diagrams showing a display device pertaining to a first exemplary embodiment.

FIG. 1A schematically shows a display device 100 pertaining to a first exemplary embodiment. This display device 100 is equipped with a display medium 10 and a drive device 20 that drives the display medium 10. The drive device 20 is configured to include a voltage application unit 30, which applies voltages between a display-side electrode 3 and a back-side electrode 4 of the display medium 10, and a controller 40, which controls the voltage application unit 30 in accordance with image data of an image to be displayed on the display medium 10.

The display medium 10 has a translucent display substrate 1 serving as an image display surface and a back substrate 2 serving as a non-display surface. The display substrate 1 and the back substrate 2 are placed opposing each other across a gap.

The display medium 10 also has a gap member 5 that keeps the space between these substrates 1 and 2 to a defined gap and sections the inter-substrate space into multiple cells.

The cells are regions surrounded by the back substrate 2 on which the back-side electrode 4 is disposed, the display substrate 1 on which the display-side electrode 3 is disposed, and the gap member 5. A dispersant 6 that is configured by a dielectric liquid, for example, and a first particle group 11, a second particle group 12, and a white particle group 13 that are dispersed in the dispersant 6 are sealed in the cells.

The first particle group 11 and the second particle group 12 have mutually different colors and charge polarities. The first particle group 11 and the second particle group 12 have the characteristic that they migrate independently of one another when the voltage application unit 30 applies a voltage equal to or greater than a predetermined threshold voltage between the pair of electrodes 3 and 4. The white particle group 13 is a particle group that has less of a charge than the first particle group 11 and the second particle group 12 and does not move to either electrode side even when a voltage by which the first particle group 11 and the second particle group 12 move to either one electrode side is applied.

By mixing a colorant into the dispersant 6, the display device 100 may also display a white differing from the color of the migrating particles.

The drive device 20 (the voltage application unit 30 and the controller 40) applies a voltage according to a color to be displayed between the display-side electrode 3 and the back-side electrode 4 of the display medium 10 to thereby cause the particle groups 11 and 12 to migrate and be attracted to either one of the display substrate 1 and the back substrate 2 depending on their respective charge polarities.

The voltage application unit 30 is electrically connected to each of the display-side electrode 3 and the back-side electrode 4. Further, the voltage application unit 30 is connected to the controller 40 such that it may send signals to and receive signals from the controller 40.

Figure 1B:
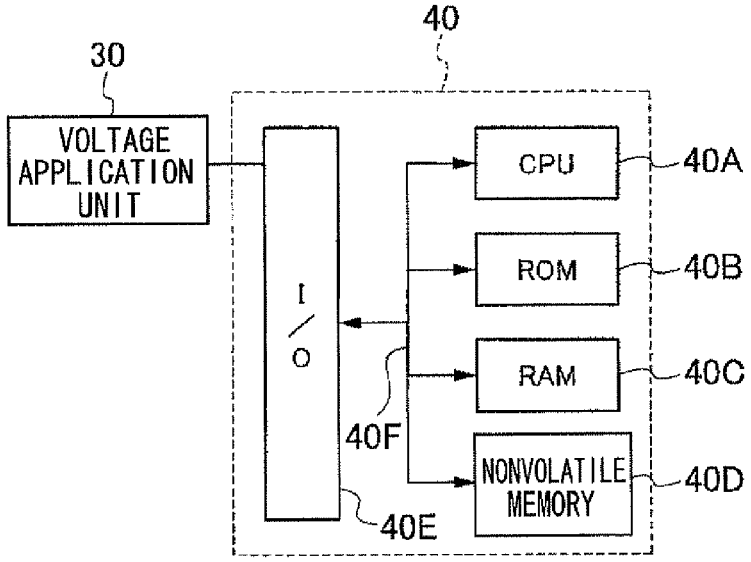

As shown in FIG. 1B, the controller 40 is configured as a computer 40, for example. The computer 40 has a configuration where a central processing unit (CPU) 40A, a read-only memory (ROM) 40B, a random access memory (RAM) 40C, a nonvolatile memory 40D, and an input/output interface (I/O) 40E are interconnected via a bus 40F. The voltage application unit 30 is connected to the I/O 40E. In this case, a program causing the computer 40 to execute processing instructing the voltage application unit 30 to apply later-described voltages needed to display each color is written in the nonvolatile memory 40D, for example, and the CPU 40A reads and executes this program. The program may also be provided by a recording medium such as a CD-ROM.

The voltage application unit 30 is a voltage application device for applying voltages to the display-side electrode 3 and the back-side electrode 4 and applies voltages according to the control of the controller 40 to the display-side electrode 3 and the back-side electrode 4.

In the present exemplary embodiment, a case where the display-side electrode 3 is grounded and the voltage application unit 30 applies voltages to the back-side electrode 4 will be described as an example.

Figure 2:
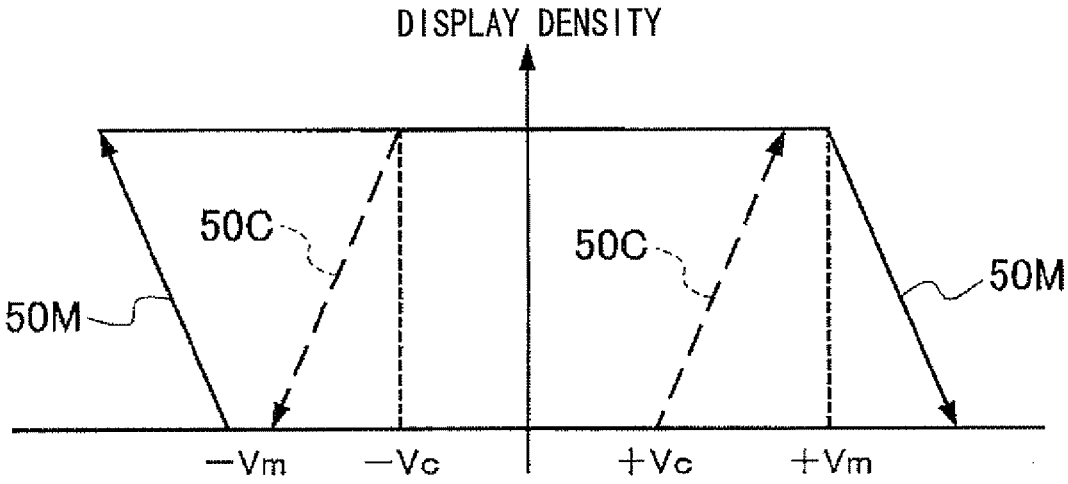
FIG. 2 is a diagram showing voltage application characteristics of migrating particles pertaining to the first exemplary embodiment.

FIG. 2 shows characteristics of applied voltages needed to cause the cyan particles C and the magenta particles M to move to the display substrate 1 side and the back substrate 2 side in the display device 100 pertaining to the present exemplary embodiment. In FIG. 2, characteristic 50C represents the applied voltage characteristic of the cyan particles C, and characteristic 50M represents the applied voltage characteristic of the magenta particles M.

FIG. 2 also shows the relationship between pulse voltages applied to the back-side electrode 4 with the display-side electrode 3 serving as a ground (0 V) and display density resulting from each particle group.

As shown in FIG. 2, −Vm is a start-of-moving voltage (threshold voltage) by which the magenta particles M on the back substrate 2 side start moving to the display substrate 1 side, and +Vm is a start-of-moving voltage (threshold voltage) by which the magenta particles M on the display substrate 1 side start moving to the back substrate 2 side. Consequently, the magenta particles M on the back substrate 2 side move to the display substrate 1 side by applying a voltage equal to or less than −Vm, and the magenta particles M on the display substrate 1 side move to the back substrate 2 side by applying a voltage equal to or greater than +Vm.

Additionally, the particle quantity in which the magenta particles M on the back substrate 2 side are caused to move to the display substrate 1 side is, in a case where the voltage value of the applied voltage is made the same, for example, controlled by the pulse width (application time) of the applied voltage (pulse width modulation). For example, in a case where the voltage value of the applied voltage is −Vm, the particle quantity of the magenta particles M caused to move to the display substrate 1 side becomes larger as the pulse width of the applied voltage becomes longer. Because of this, gradation display of the magenta particles M is controlled. The same is true of the particle quantity in the case of causing the magenta particles M on the display substrate 1 side to move to the back substrate 2 side.

Further, +Vc is a start-of-moving voltage (threshold voltage) by which the cyan particles C on the back substrate 2 side start moving to the display substrate 1 side, and −Vc is a start-of-moving voltage (threshold voltage) by which the cyan particles C on the display substrate 1 side start moving to the back substrate 2 side. Consequently, the cyan particles C on the back substrate 2 side move to the display substrate 1 side by applying a voltage equal to or greater than +Vc, and the cyan particles C on the display substrate 1 side move to the back substrate 2 by applying a voltage equal to or less than −Vc.

Additionally, the particle quantity in which the cyan particles C on the back substrate 2 side are caused to move to the display substrate 1 side and the particle quantity in which the cyan particles C on the display substrate 1 side are caused to move to the back substrate 2 side are, in a case where the voltage value of the applied voltage is made the same, for example, like in the case of the magenta particles M, controlled by the pulse width of the applied voltage.

Gradation display made also be controlled by making the pulse width of the applied voltage the same and changing the voltage value of the applied voltage to thereby control the moving particle quantity (voltage modulation). For example, in the case of controlling the particle quantity in which the magenta particles M on the back substrate 2 side are caused to move to the display substrate 1 side, the pulse width of the applied voltage is made the same and the voltage value is given an arbitrary voltage value equal to or less than −Vm. Because of this, the magenta particles M in the particle quantity according to that voltage value are caused to move to the display substrate 1 side.

Below, a case where the voltage value of the voltage that is applied in order to cause the magenta particles M to move is −Vm or +Vm, the voltage value of the voltage that is applied in order to cause the cyan particles C to move is −Vc or +Vc, and the particle quantity of the moving particles is controlled by making the pulse width variable will be described as an example.

Next, display of each color will be described. The display-side electrode 3 will serve as a ground (0 V). Further, it will be assumed that the magenta particles M and the cyan particles C are sealed in the inter-substrate space in the same quantities.

FIGS. 3 to 6 schematically show examples of the behavior of the magenta particles M and the cyan particles C in response to voltage application in the display medium 10 pertaining to the first exemplary embodiment. In FIGS. 3 to 6, the white particles 13, the dispersant 6, the gap member 5, and so forth are omitted.

In the present exemplary embodiment, a case where the first particles 11 are negatively-charged electrophoretic particles having a magenta color (the magenta particles M) and the second particles 12 are positively-charged electrophoretic particles having a cyan color (the cyan particles C) will be described, but the exemplary embodiment is not limited to this. It suffices for the color and the charge polarity of each particle to be appropriately set. Further, the values of the applied voltages in the description below are only examples and are not limited to these. It suffices for the values of the applied voltages to be appropriately set depending on the charge polarity of each particle, responsiveness, inter-electrode distance, and so forth.

Figure 3:
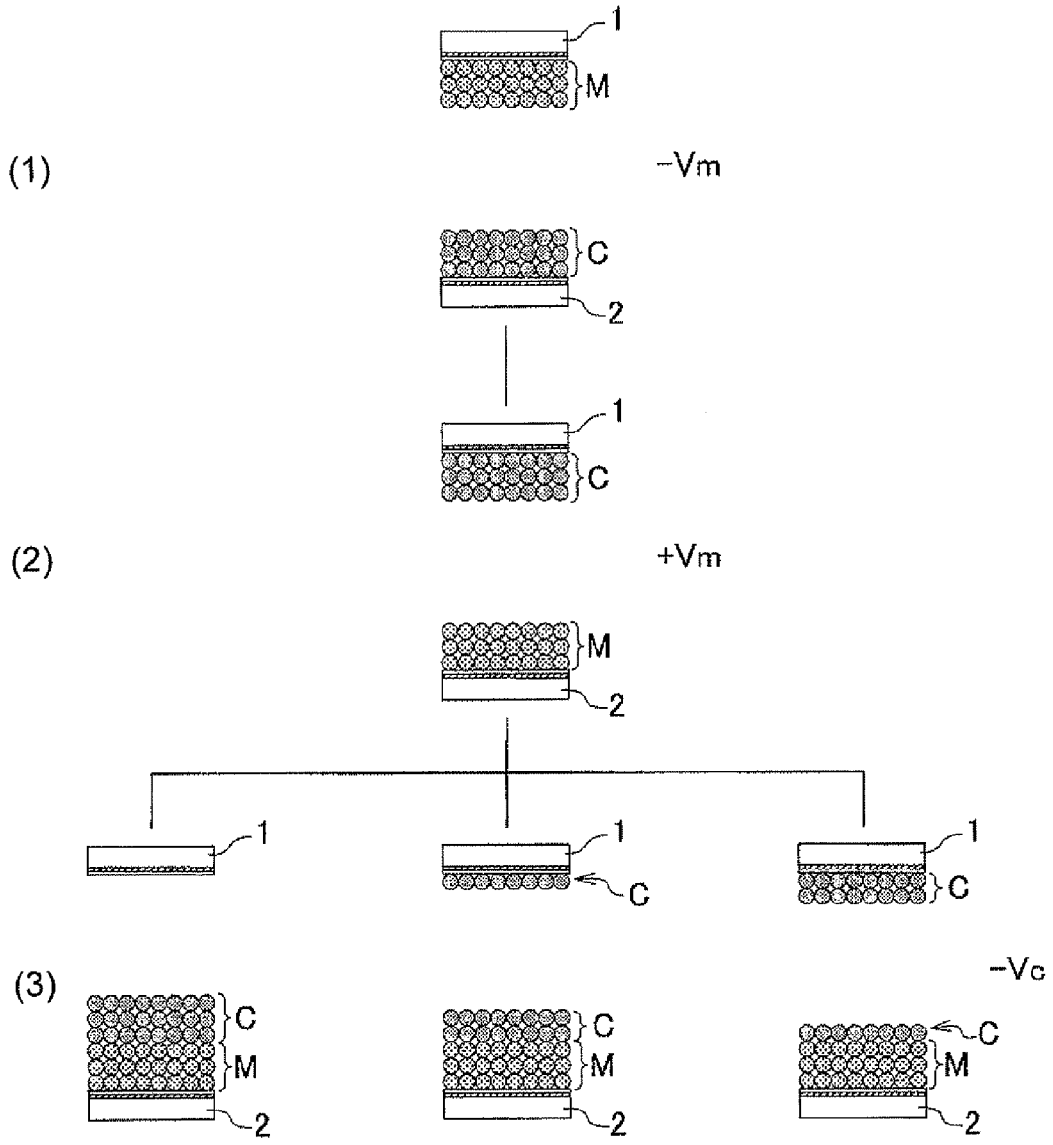
FIG. 3 is a schematic diagram showing the behavior of the migrating particles in response to voltage application in the display device pertaining to the first exemplary embodiment.

As shown in FIG. 3(1), the voltage application unit 30 applies a voltage of −Vm to the back-side electrode 4 with a pulse width needed to cause all of the magenta particles M on the back substrate 2 side to attach to the display substrate 1 side. When this happens, all of the negatively-charged magenta particles M migrate to the display substrate 1 side, and the positively-charged cyan particles C migrate to the back substrate 2 side, whereby the particles become attached to the entire surface of each substrate. Because of this, magenta is displayed.

From the state (magenta display) in FIG. 3(1), as shown in FIG. 3(2), the voltage application unit 30 applies a voltage of +Vm to the back-side electrode 4 with a pulse width needed to cause all of the magenta particles M on the display substrate 1 side to attach to the back substrate 2 side and to cause all of the cyan particles C on the back substrate 2 side to attach to the display substrate 1 side. When this happens, the positively-charged cyan particles C migrate to the display substrate 1 side, and the negatively-charged magenta particles M migrate to the back substrate 2 side, whereby the particles become attached to the entire surface of each substrate. Because of this, cyan is displayed.

From the state (cyan display) in FIG. 3(2), as shown in FIG. 3(3), the voltage application unit 30 applies a voltage of −Vc to the back-side electrode 4 with a pulse width needed to cause, of the cyan particles C on the display substrate 1 side, the cyan particles C in the particle quantity according to the gradation to be displayed to remain on the display substrate 1 side and to cause the other cyan particles C (the cyan particles C to be detached from the display substrate 1) to move to the back substrate 2 side. When this happens, the cyan particles C in the particle quantity to be detached in accordance with the gradation migrate to the back substrate 2 side and become attached to the back substrate 2 side. FIG. 3(3) shows cases where the cyan particles C moving to the back substrate 2 side become fewer in the order of the left side, the middle, and the right side. That is, the pulse width of the applied voltage becomes shorter in the order of the left side, the middle, and the right side in FIG. 3(3).

Figure 4:
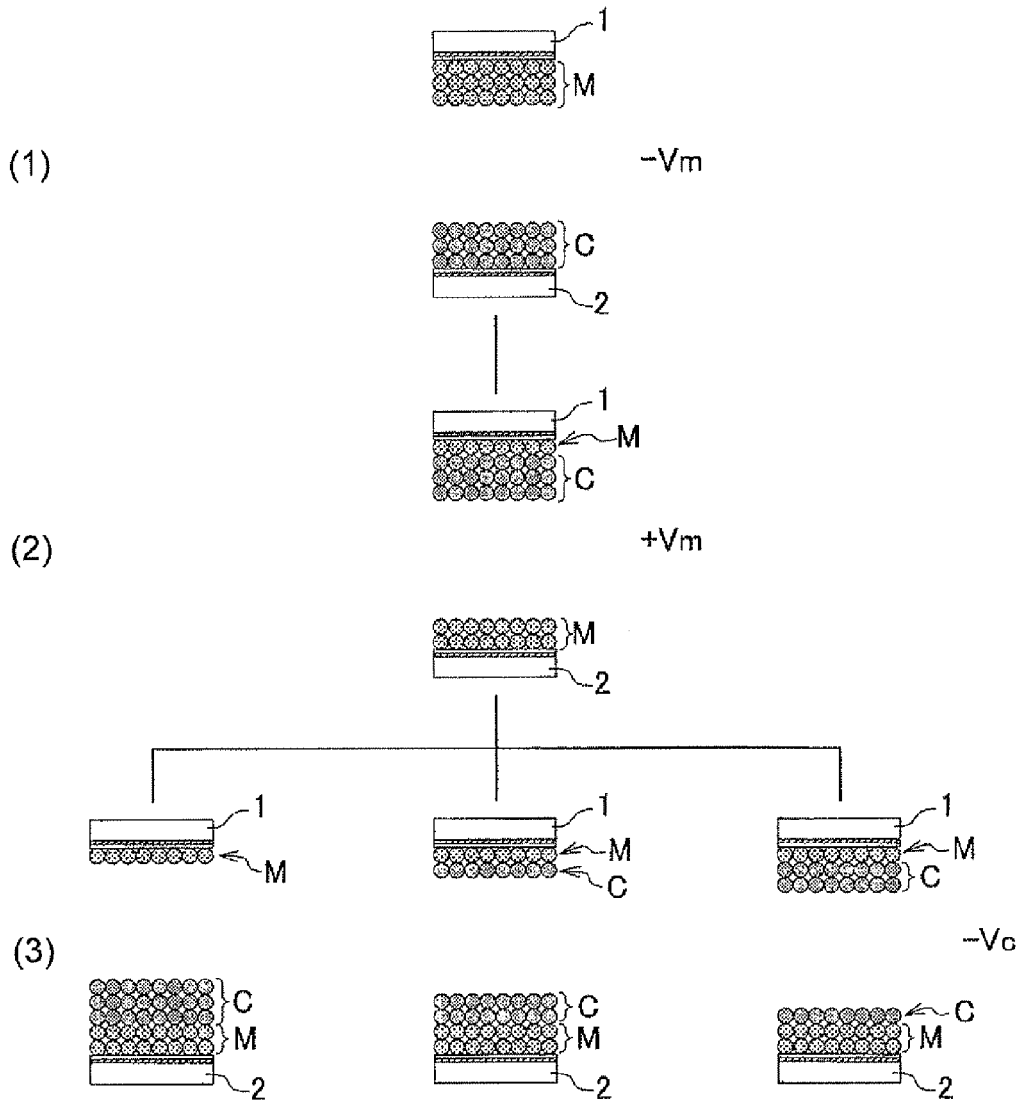
FIG. 4 is a schematic diagram showing the behavior of the migrating particles in response to voltage application in the display device pertaining to the first exemplary embodiment.

From the state (magenta display) in FIG. 4(1) (which is identical to FIG. 3(1)), as shown in FIG. 4(2), the voltage application unit 30 applies a voltage of +Vm to the back-side electrode 4 with a pulse width needed to cause, of the magenta particles M on the display substrate 1 side, the magenta particles M in the particle quantity according to the gradation to be displayed to remain on the display substrate 1 side and to cause the other magenta particles M (the magenta particles M to be detached from the display substrate 1) to move to the back substrate 2 side. When this happens, the magenta particles M in the particle quantity to be detached in accordance with the gradation migrate to the back substrate 2 side and become attached to the back substrate 2 side, and the cyan particles C migrate to the display substrate 1 side and become attached to the display substrate 1.

Then, from the state in FIG. 4(2), as shown in FIG. 4(3), the voltage application unit 30 applies a voltage of −Vc to the back-side electrode 4 with a pulse width needed to cause, of the cyan particles C on the display substrate 1 side, the cyan particles C in the particle quantity according to the gradation to be displayed to remain on the display substrate 1 side and to cause the other cyan particles (the cyan particles C to be detached from the display substrate 1) to attach to the back substrate 2 side. When this happens, the cyan particles C in the particle quantity to be detached in accordance with the gradation migrate to the back substrate 2 side and become attached to the back substrate 2 side.

FIG. 4(3) shows cases where, like in FIG. 3(3), the cyan particles C moving to the back substrate 2 side become fewer in the order of the left side, the middle, and the right side. That is, the pulse width of the applied voltage becomes shorter in the order of the left side, the middle, and the right side in FIG. 4(3).

Figure 5:
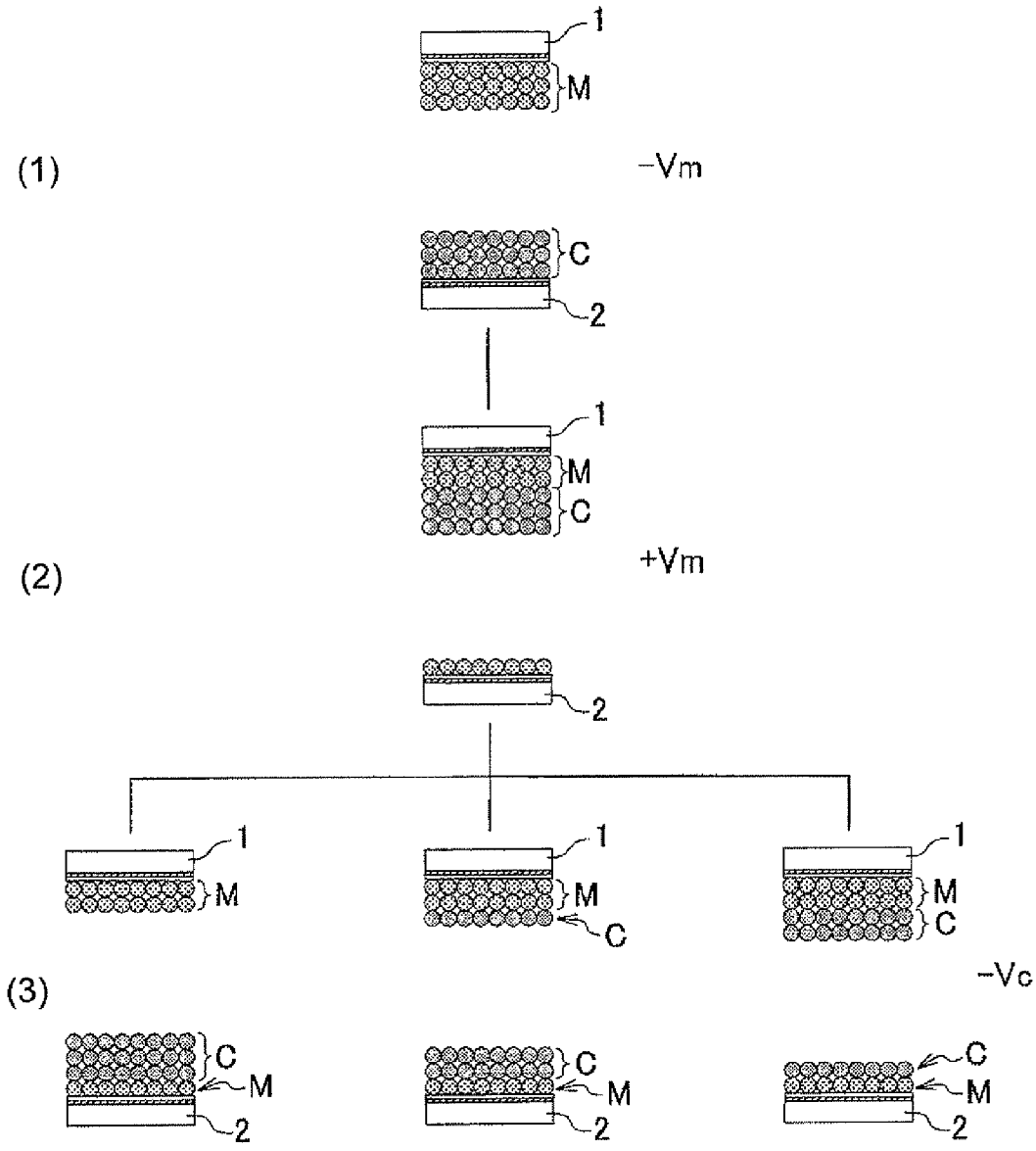
FIG. 5 is a schematic diagram showing the behavior of the migrating particles in response to voltage application in the display device pertaining to the first exemplary embodiment.
Figure 6:
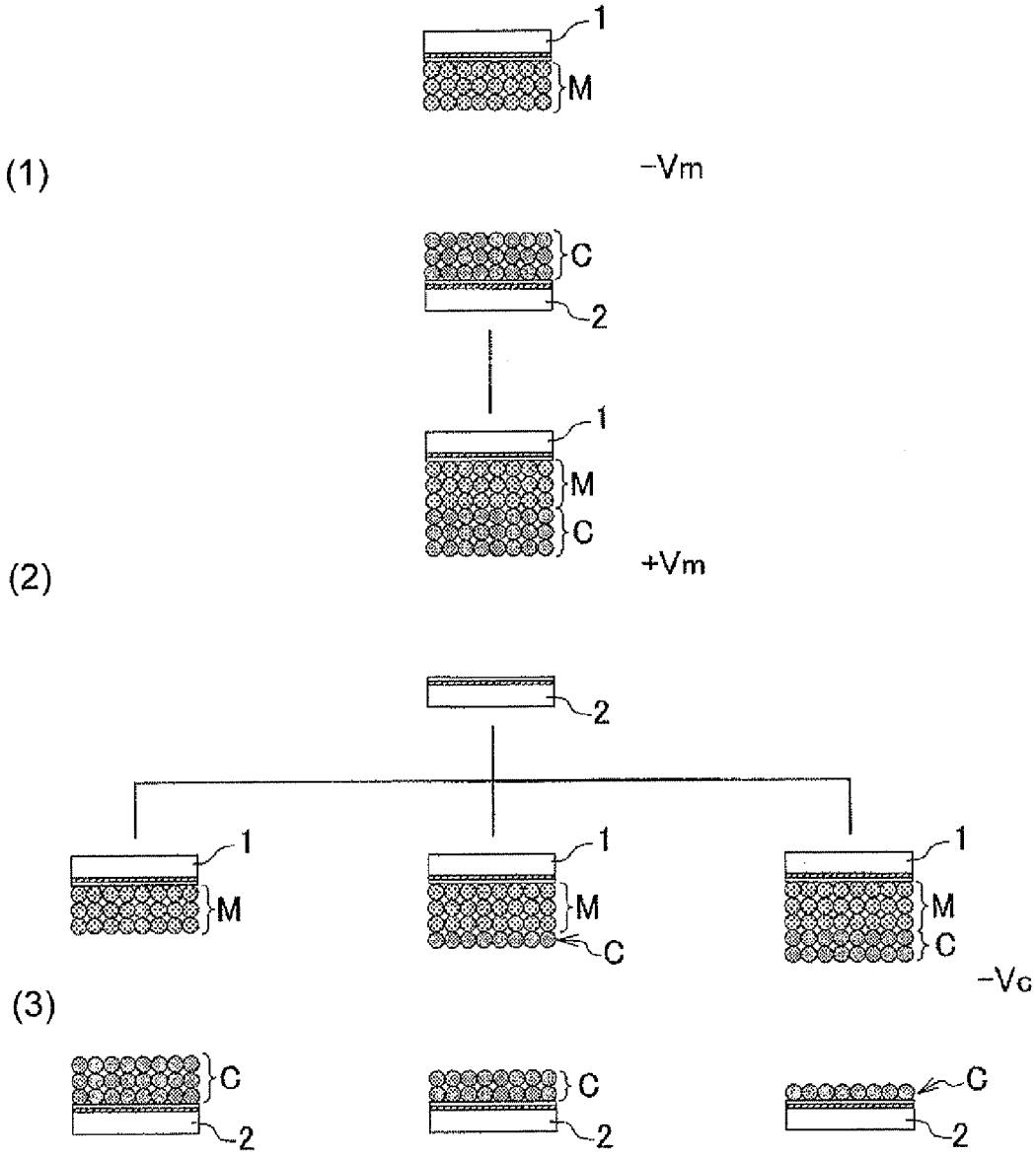
FIG. 6 is a schematic diagram showing the behavior of the migrating particles in response to voltage application in the display device pertaining to the first exemplary embodiment.

FIG. 5 and FIG. 6 are the same as FIG. 4 except that the particle quantity of the magenta particles M moving to the back substrate 2 side when transitioning from FIG. 5(1) to FIG. 5(2) and when transitioning from FIG. 6(1) to FIG. 6(2) is different.

Figure 7:
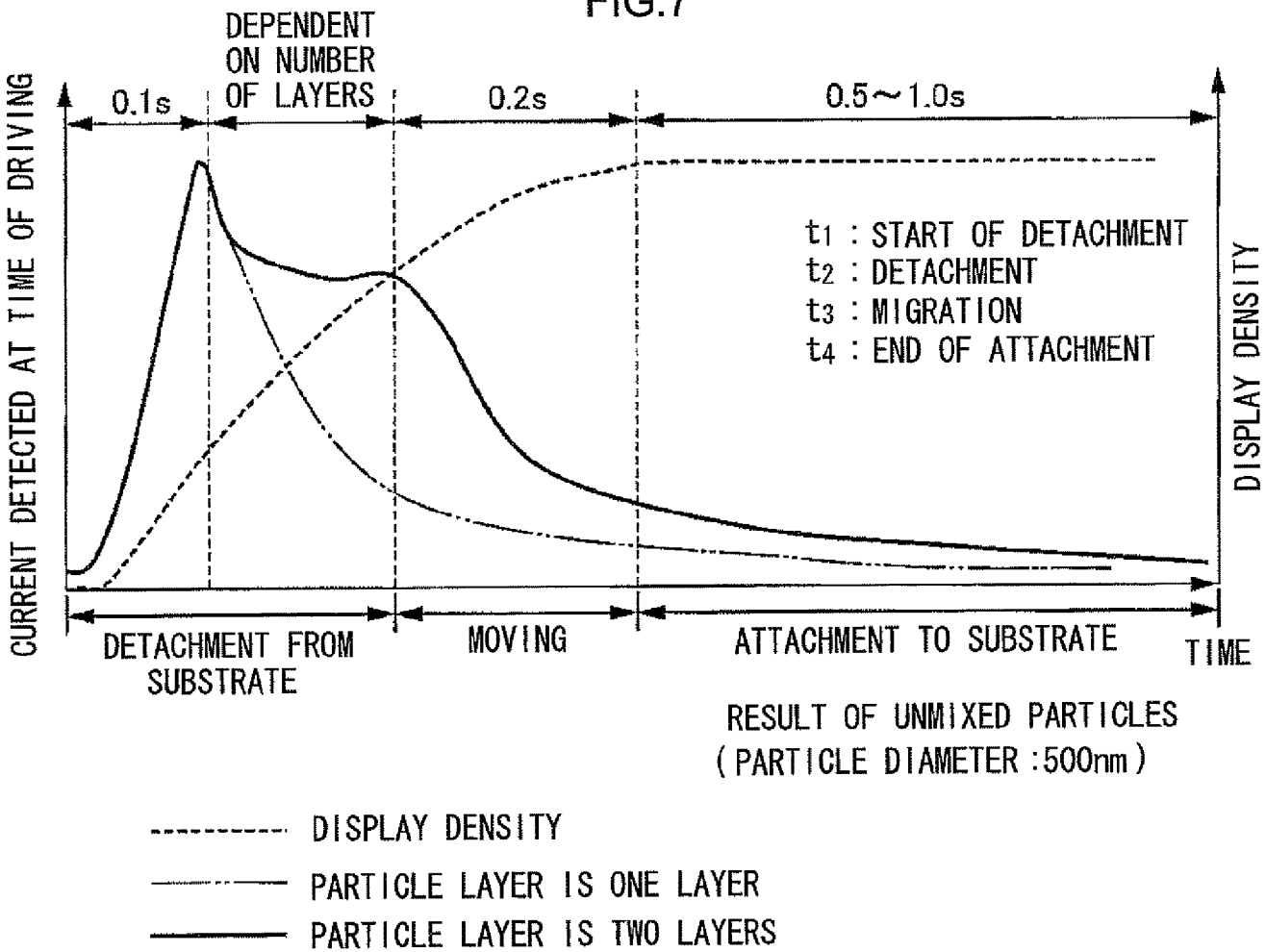
FIG. 7 is a diagram showing characteristics of detachment, movement, and attachment of the particles with respect to substrates.

FIG. 7 shows characteristics of detachment, movement, and attachment of the particles with respect to the substrates. As shown in FIG. 7, the particles detach from one substrate, move, and attach to the other substrate. However, there are variations in the particle characteristics, and the states of attachment of the particles with respect to the substrates also differ. Thus, even when the voltage application unit 30 applies a voltage, the particles do not detach all together from the substrate but detach beginning with the particles that move easily. Additionally, it takes a certain amount of time to cause the particles that have detached from one substrate to attach to the other substrate. For this reason, if the pulse width of the applied voltage is short, sometimes the particles do not sufficiently attach to the substrates.

Figure 8:
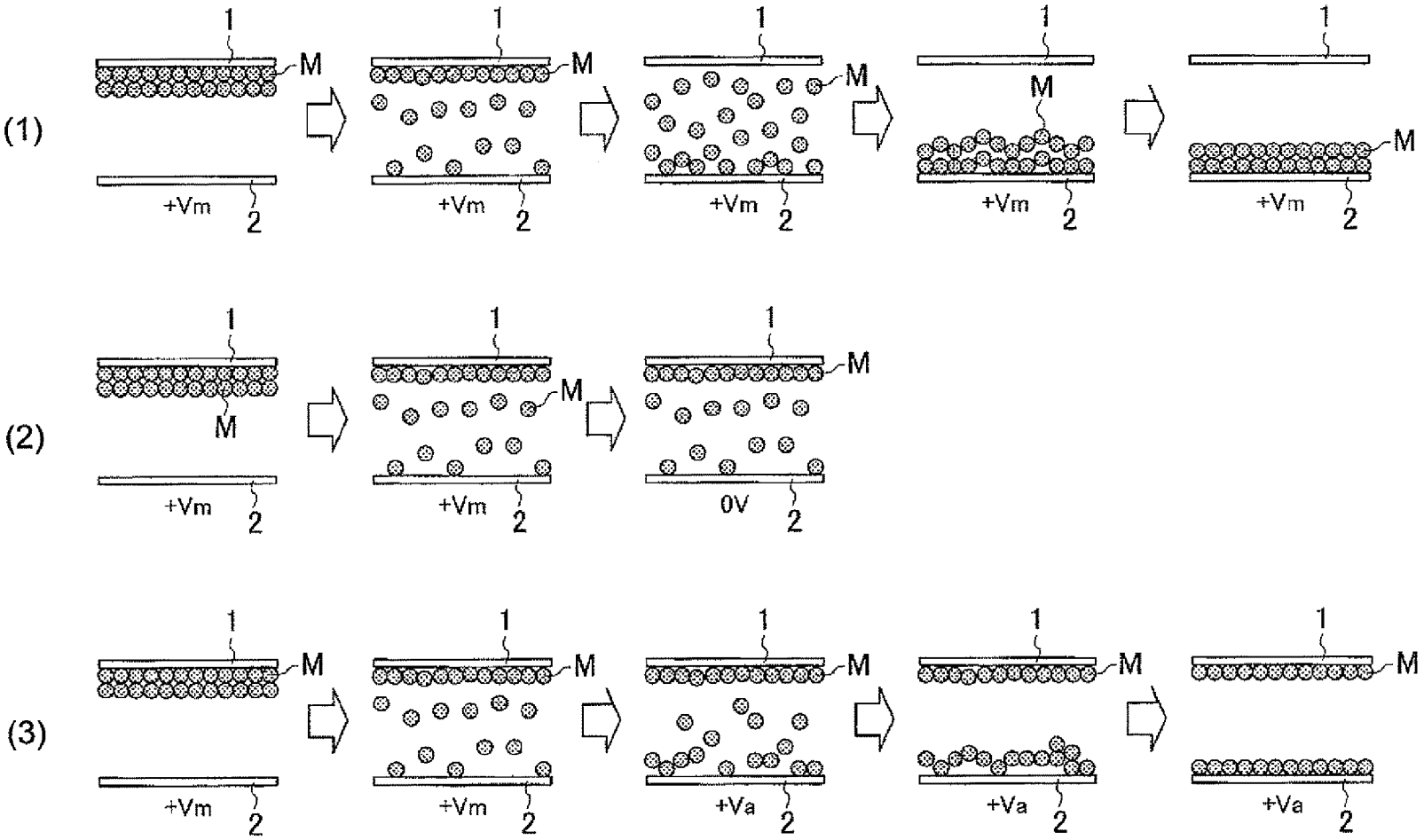
FIG. 8 is a schematic diagram showing the behavior of the migrating particles in response to voltage application in the display device pertaining to the first exemplary embodiment.

In conventional binary driving, for example, as shown in FIG. 8(1), in a case where the voltage application unit 30 has applied a voltage of +Vm to the back-side electrode 4 in order to cause the magenta particles M to move from the display substrate 1 side to the back substrate 2 side, it takes time until the magenta particles M move from the display substrate 1 side to the back substrate 2 side and completely attach to the back substrate 2 side.

Further, in the case of displaying a gradation, as shown in FIG. 8(2), the voltage application unit 30 applies a voltage of +Vm to the back-side electrode 4 with a pulse width needed to cause the magenta particles M in the particle quantity according to the gradation to remain on the display substrate 1 side and to cause the other magenta particles M to move to the back substrate 2 side. In this case, the pulse width of the applied voltage is shorter than in the case of causing all of the magenta particles M to move to the back substrate 2 side as shown in FIG. 8(1). However, as shown in FIG. 8(2), after the voltage application unit 30 stops voltage application, the magenta particles M that have detached float in the inter-substrate space.

Figure 9:
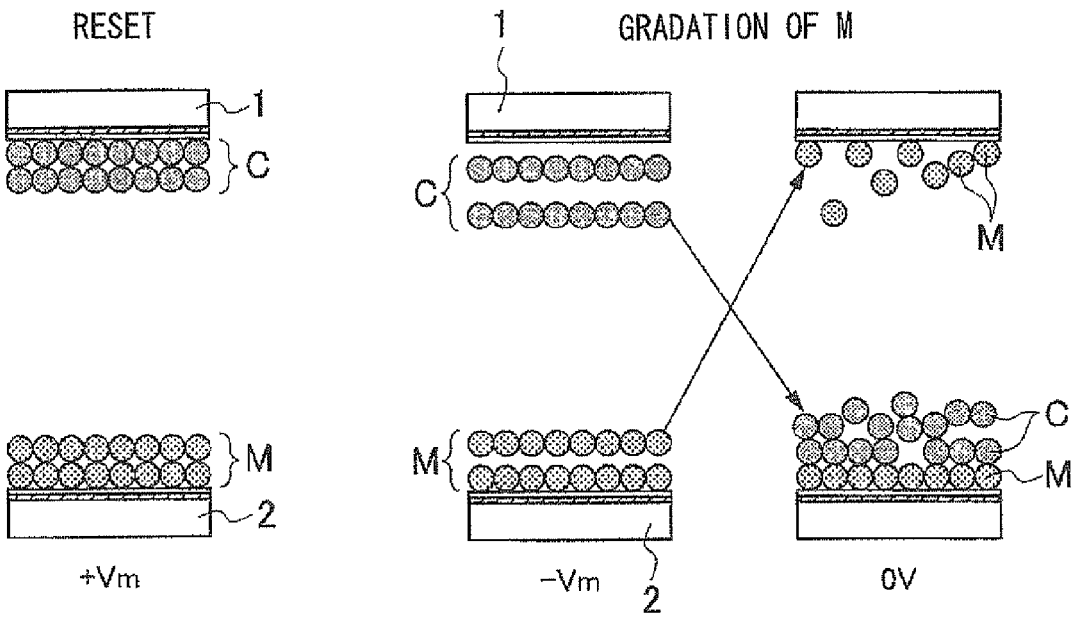
FIG. 9 is a schematic diagram showing the behavior of the migrating particles in response to voltage application in the display device pertaining to the first exemplary embodiment.

Further, as shown in FIG. 9, in the case of displaying a gradation of the magenta particles M with a configuration in which the magenta particles M and the cyan particles C charged to different polarities are included, the voltage application unit 30 applies the voltage +Vm to the back-side electrode 4 to reset the display (cyan display) and thereafter applies the voltage −Vm to the back-side electrode 4 with a pulse width according to the gradation. In this case, all of the cyan particles C move to the back substrate 2 side, and the magenta particles M in the particle quantity according to the gradation move to the display substrate 1 side. However, sometimes not all of the magenta particles M that have detached from the back substrate 2 sufficiently attach to the display substrate 1, and some of the magenta particles M end up floating in the inter-substrate space.

For this reason, in the present exemplary embodiment, as shown in FIG. 8(3), in the case of performing gradation display of the magenta particles M, the voltage application unit 30 first applies a voltage (e.g., 15 V) of +Vm to the back-side electrode 4 with a pulse width according to the gradation to cause the magenta particles M in the particle quantity according to the gradation to detach from the display substrate 1. Thereafter, the voltage application unit 30 applies a voltage +Va (e.g., 10 V), whose polarity is the same as that of +Vm and whose voltage value is lower than that of +Vm, needed to cause the magenta particles M to move. Because of this, the magenta particles M that have detached from the display substrate 1 sufficiently attach to the back substrate 2 without floating.

Next, control executed by the CPU 40A of the controller 40 will be described with reference to the flowchart shown in FIG. 10 as the action of the present exemplary embodiment.

First, in step S10, the CPU 40A acquires image data of an image to be displayed on the display device 100 from an unillustrated external device via the I/O 40E, for example.

Figure 11:
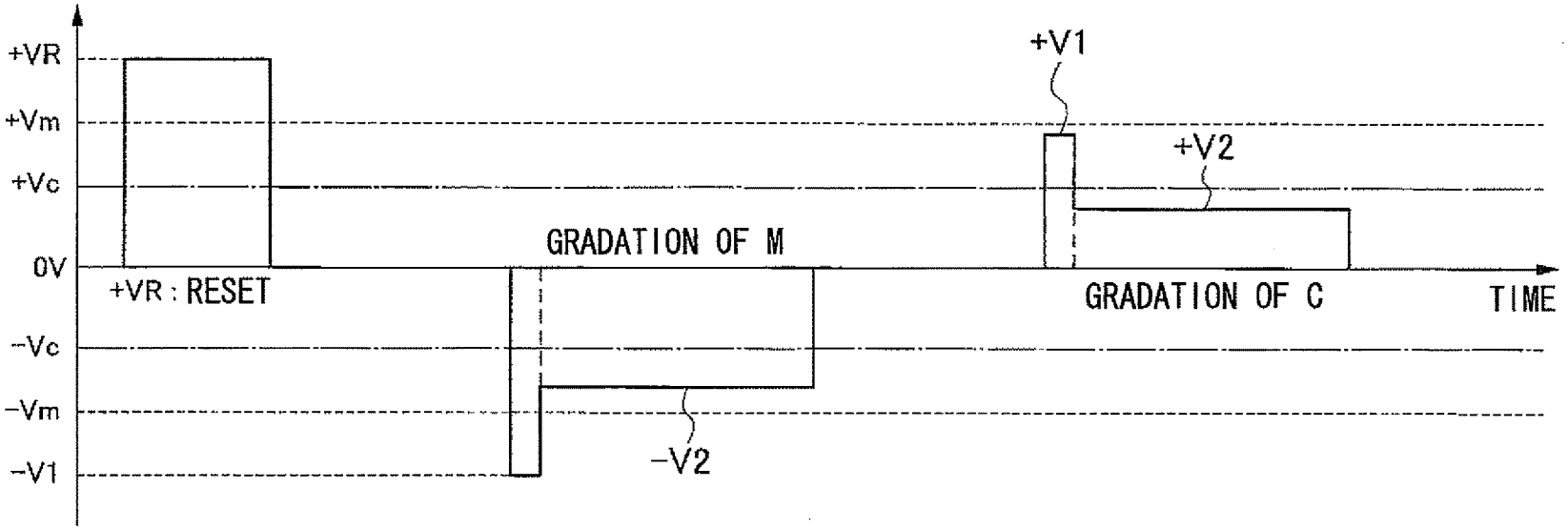
FIG. 11 is a diagram for describing a voltage application sequence when applying voltages in the display device pertaining to the first exemplary embodiment.

In step S12, the CPU 40A instructs the voltage application unit 30 to apply a reset voltage VR. Here, it will be assumed that the reset voltage VR is a voltage for causing all of the cyan particles C to move to the display substrate 1 side and for causing all of the magenta particles M to move to the back substrate 2 side. That is, as shown in FIG. 11, the reset voltage VR is a higher voltage than the threshold voltage +Vm of the magenta particles M. For this reason, as shown in FIG. 12(1), when the reset voltage VR is applied to the back-side electrode 4, all of the cyan particles C move and attach to the display substrate 1 side and all of the magenta particles M move and attach to the back substrate 2 side.

In step S14, the CPU 40A decides a first voltage to be applied to the back-side electrode 4 on the basis of the image data it has acquired and instructs the voltage application unit 30 to apply the first voltage. The voltage application unit 30 applies the first voltage instructed by the controller 40 to the back-side electrode 4.

The first voltage is a voltage according to the gradation of the color to be displayed on the display device 100. For example, in the case of performing gradation display of magenta, for example, as shown in FIG. 11, the first voltage is a voltage −V1 that is lower than −Vm, which is the threshold voltage of the magenta particles M, and the pulse width of the first voltage is a pulse width according to the gradation (density) of magenta to be displayed. The pulse width may also be the same and the CPU 40A may also control the gradation with the voltage value.

Figure 12:
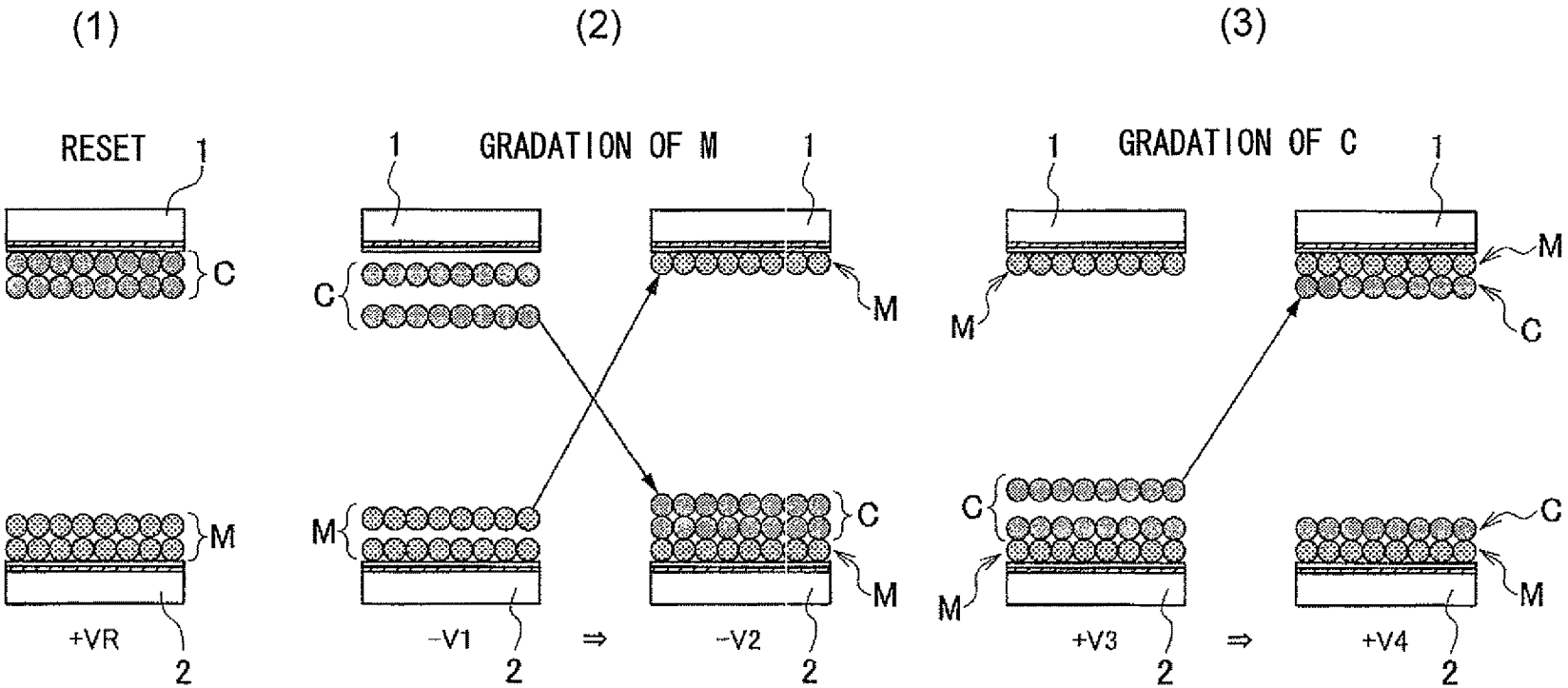
FIG. 12 is a schematic diagram showing the behavior of the migrating particles in response to voltage application in the display device pertaining to the first exemplary embodiment.

By applying the voltage −V1 to the back-side electrode 4, as shown in FIG. 12(2), the magenta particles M in the particle quantity according to the applied voltage move from the back substrate 2 to the display substrate 1 side, and all of the cyan particles C move from the display substrate 1 to the back substrate 2 side.

In step S16, the CPU 40A instructs the voltage application unit 30 to apply to the back-side electrode 4 a second voltage for causing the particles that have detached from one substrate to move to the other substrate. The voltage application unit 30 applies the second voltage instructed by the controller 40 to the back-side electrode 4.

This second voltage is a voltage having the same polarity as the first voltage and in which the absolute value of the voltage value is smaller than that of the first voltage. For example, in the case of performing gradation display of magenta, for example, as shown in FIG. 11, the second voltage is a voltage −V2 that is higher (has a smaller absolute value) than −Vm, which is the threshold voltage of the magenta particles M, and the pulse width of the second voltage is a pulse width by which the magenta particles M that have detached from the display substrate 1 sufficiently attach to the back substrate 2. As shown in FIG. 11, the second voltage may also be a voltage that is lower (has a larger absolute value) than the threshold voltage −Vc of the cyan particles C.

By applying the voltage −V2 to the back-side electrode 4 after applying the voltage −V1, as shown in FIG. 12(2), the magenta particles M that have detached from the back substrate 2 attach to the display substrate 1 without floating in the inter-substrate space.

In the case of performing gradation control of the cyan particles C from this state, as shown in FIG. 11, the voltage application unit 30 applies, as the first voltage, a voltage +V1 that is higher than the threshold voltage +Vc of the cyan particles C and is lower than the threshold voltage +Vm of the magenta particles to the back-side electrode 4 with a pulse width according to the gradation. Thereafter, the voltage application unit 30 applies, as the second voltage, a voltage +V2 that is lower than the threshold voltage +Vc. Because of this, as shown in FIG. 12(3), the cyan particles C in the particle quantity according to the applied voltage move from the back substrate 2 to the display substrate 1 side and attach to the display substrate 1 side.

Figure 13:
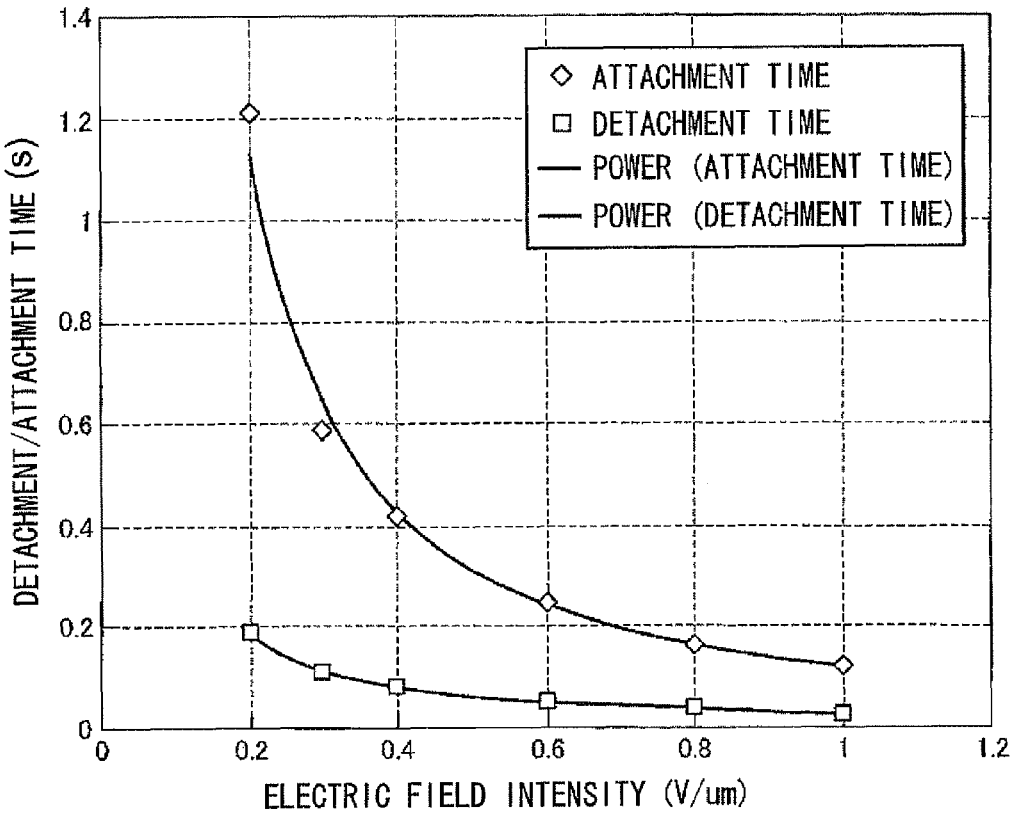
FIG. 13 is a diagram showing the relationship between the detachment time and the attachment time of the particles and the intensity of an electric field between the substrates.

FIG. 13 shows results in which the present inventor measured the relationship between the detachment time in a case where the particles all detach from one substrate and the attachment time in which all of the particles that have detached attach to the other substrate and the intensity of the electric field in the inter-substrate space formed by the voltage that has been applied when causing the particles to detach or attach.

As shown in FIG. 13, it will be understood that the detachment time is about ⅕ the attachment time and that the attachment time becomes shorter as the intensity of the electric field when causing the particles to attach becomes greater.

Additionally, in the case of controlling gradation, it is thought that the attachment time in which the particles that have detached attach also becomes shorter as the particle quantity of the particles to be detached becomes smaller.

Therefore, the pulse width of the second voltage may be decided in accordance with the gradation. That is, the pulse width of the second voltage may be decided in accordance with the pulse width of the first voltage in the case of pulse width modulation and in accordance with the voltage value of the first voltage in the case of voltage modulation so that, for example, the pulse width of the second voltage is made shorter in a case where the particle quantity of the particles to be detached is small and the pulse width of the second voltage is made longer in a case where the particle quantity of the particles to be detached is large.

Further, the pulse width of the second voltage may be made the same and its voltage value may be decided in accordance with the gradation. That is, the voltage value of the second voltage may be decided in accordance with the pulse width of the first voltage in the case of pulse width modulation and in accordance with the voltage value of the first voltage in the case of voltage modulation so that, for example, the voltage value of the second voltage is made smaller in a case where the particle quantity of the particles to be detached is small and the voltage value of the second voltage is made larger in a case where the particle quantity of the particles to be detached is large.

As shown in FIG. 13, the attachment time becomes shorter as the intensity of the electric field becomes greater. Thus, in a case where responsiveness is considered, the voltage value of the second voltage may be a voltage value less than, but as close as possible to, the threshold voltage of the particles whose gradation is to be controlled. For example, the second voltage −V2 in the case of controlling the gradation of the magenta particles M as shown in FIG. 11 may be a voltage value as close as possible to the threshold voltage −Vm.

Second Exemplary Embodiment

Next, a second exemplary embodiment of the present invention will be described. In the present exemplary embodiment, a display medium having three types of electrophoretic particles will be described.

The display medium pertaining to the present exemplary embodiment has a configuration in which positively-charged cyan particles C, negatively-charged magenta particles M, and negatively-charged yellow particles Y that are larger in diameter than the cyan particles C and the magenta particles M are dispersed as electrophoretic particles in the dispersant. The drive device 20 is the same as in the first exemplary embodiment, so description thereof will be omitted.

Figure 14:
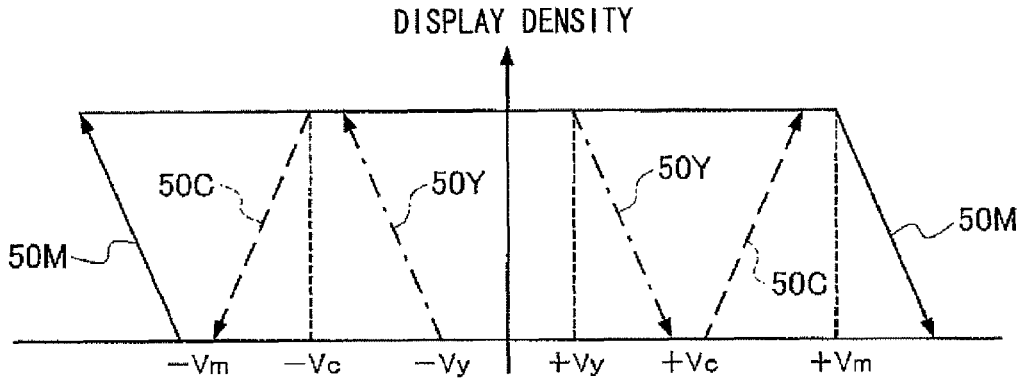
FIG. 14 is a diagram showing voltage application characteristics of migrating particles pertaining to a second exemplary embodiment.

FIG. 14 shows characteristics of applied voltages needed to cause the cyan particles C, the magenta particles M, and the yellow particles Y to move to the display substrate 1 side and the back substrate 2 side in the display device 100 pertaining to the present exemplary embodiment. In FIG. 14, characteristic 50C represents the applied voltage characteristic of the cyan particles C, characteristic 50M represents the applied voltage characteristic of the magenta particles M, and characteristic 50Y represents the applied voltage characteristic of the yellow particles Y.

FIG. 14 also shows the relationship between pulse voltages applied to the back-side electrode 4 with the display-side electrode 3 serving as a ground (0 V) and display density resulting from each particle group.

The applied voltage characteristics of the cyan particles C and the magenta particles M are the same as those in the first exemplary embodiment, so description thereof will be omitted and the applied voltage characteristic 50Y of the yellow particles Y will be described.

As shown in FIG. 14, −Vy is a start-of-moving voltage (threshold voltage) by which the yellow particles Y on the back substrate 2 side start moving to the display substrate 1 side, and +Vy is a start-of-moving voltage (threshold voltage) by which the yellow particles Y on the display substrate 1 side start moving to the back substrate 2 side. Consequently, the yellow particles Y on the back substrate 2 side move to the display substrate 1 side by applying a voltage equal to or less than −Vy, and the yellow particles Y on the display substrate 1 side move to the back substrate 2 side by applying a voltage equal to or greater than +Vy is applied. As shown in FIG. 14, $|Vm|>|Vc|>|Vy|$.

Additionally, the particle quantity in which the yellow particles Y on the back substrate 2 side are caused to move to the display substrate 1 side is, in a case where the voltage value of the applied voltage is made the same, for example, controlled by the pulse width of the voltage of the applied voltage (pulse width modulation). For example, in a case where the voltage value of the applied voltage is −Vy, the particle quantity of the yellow particles Y caused to move to the display substrate 1 side becomes larger as the pulse width of the voltage becomes longer. Because of this, gradation display of the yellow particles Y is controlled. The same is true of the particle quantity in the case of causing the yellow particles Y on the display substrate 1 side to move to the back substrate 2 side.

Gradation display may also be controlled by making the pulse width of the applied voltage the same and changing the voltage value of the applied voltage to thereby control the moving particle quantity (voltage modulation). For example, in the case of controlling the particle quantity in which the yellow particles Y on the back substrate 2 side are caused to move to the display substrate 1 side, the pulse width of the applied voltage is made the same and the voltage value is given an arbitrary voltage value equal to or less than −Vy. Because of this, the yellow particles Y in the particle quantity according to that voltage value are caused to move to the display substrate 1 side.

Below, a case where the voltage value of the voltage that is applied in order to cause the yellow particles Y to move is −Vy or +Vy and the particle quantity of the moving particles is controlled by making the pulse width variable will be described as an example.

Next, display of each color will be described. The display-side electrode 3 will serve as a ground (0 V).

Figure 15:
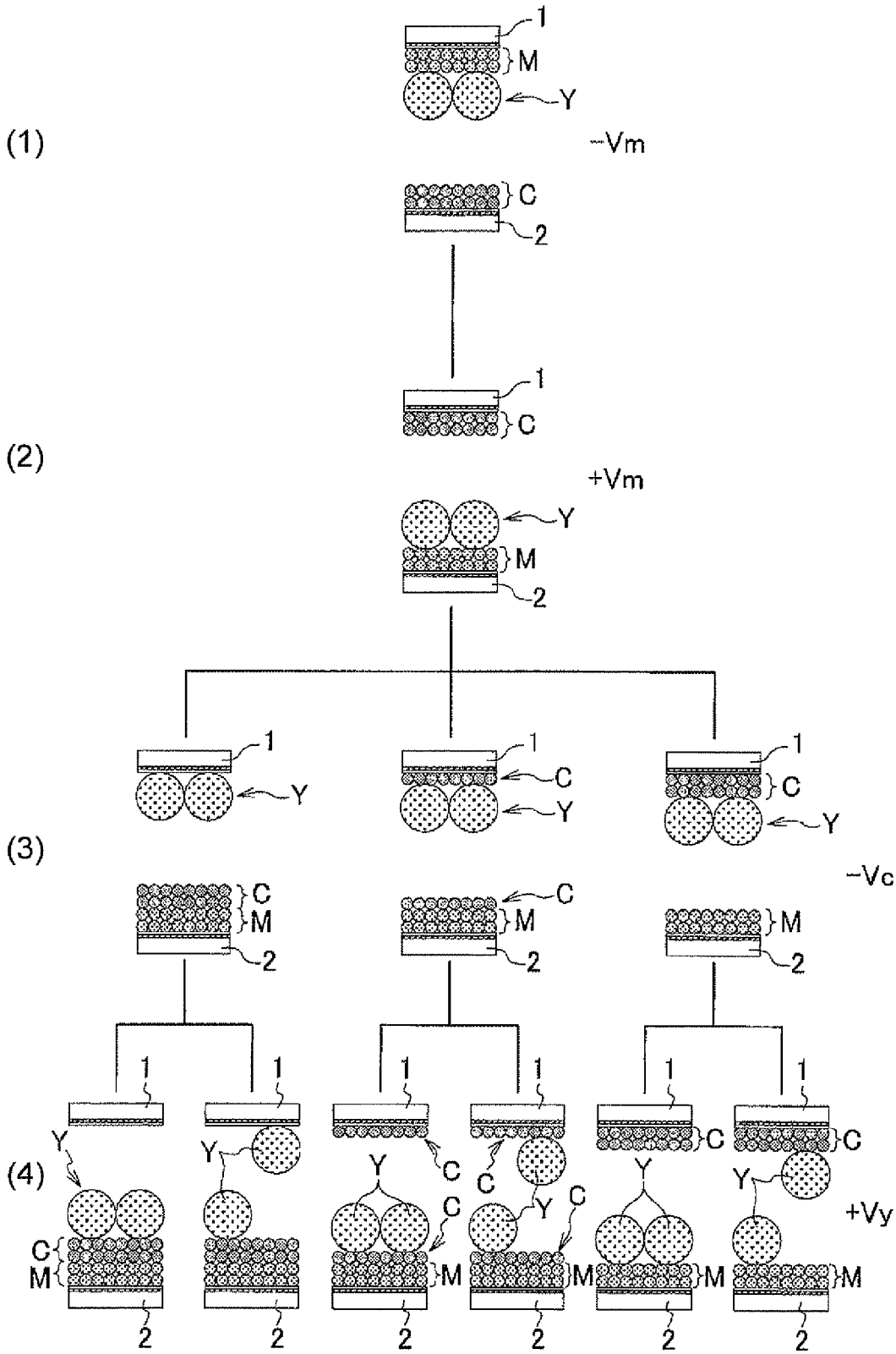
FIG. 15 is a schematic diagram showing the behavior of the migrating particles in response to voltage application in a display device pertaining to the second exemplary embodiment.
Figure 16:
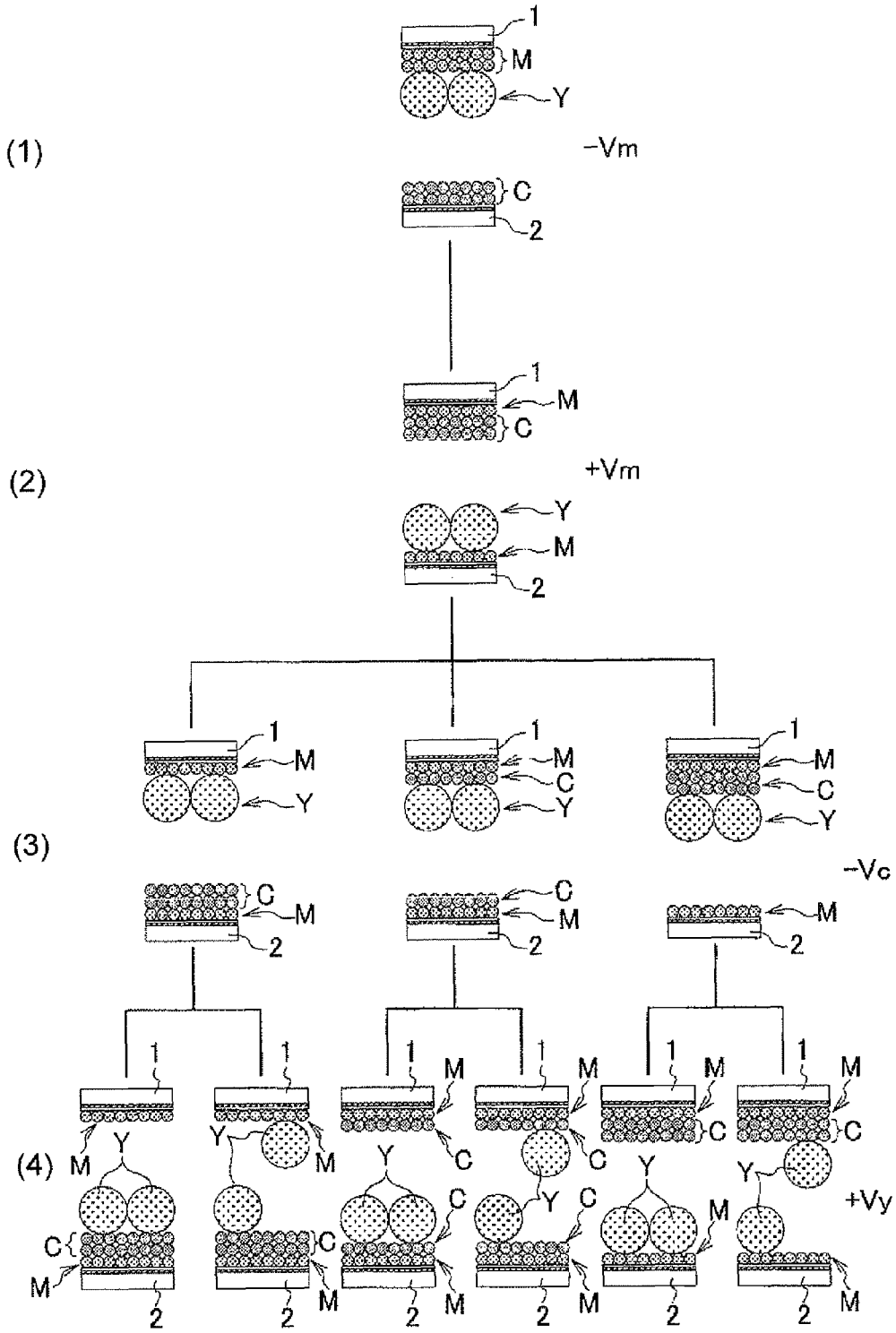
FIG. 16 is a schematic diagram showing the behavior of the migrating particles in response to voltage application in the display device pertaining to the second exemplary embodiment.
Figure 17:
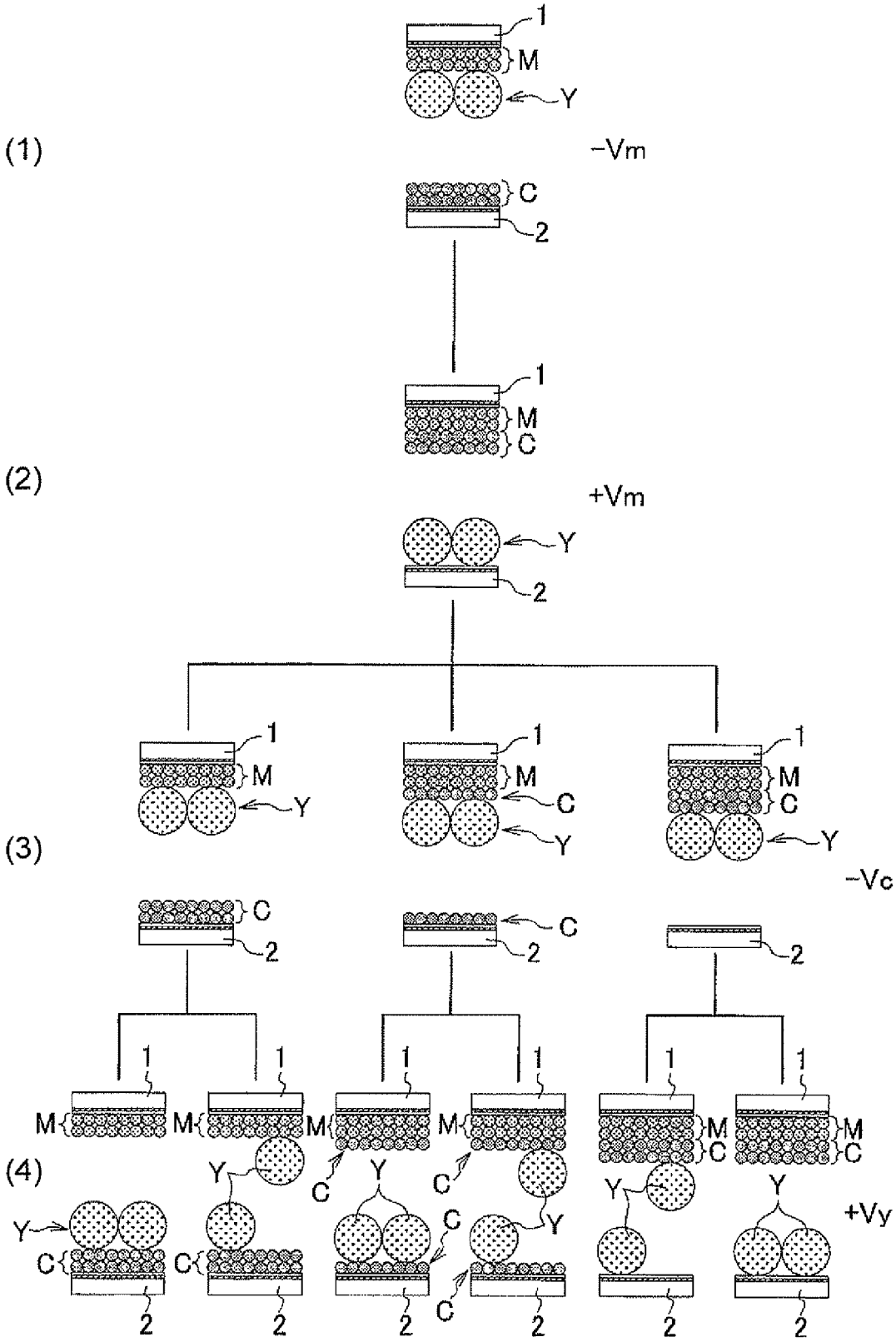
FIG. 17 is a schematic diagram showing the behavior of the migrating particles in response to voltage application in a display device pertaining to the second exemplary embodiment.

FIGS. 15 to 17 schematically show examples of the behavior of the magenta particles M, the cyan particles C, and the yellow particles Y in response to voltage application in the display medium 10 pertaining to the second exemplary embodiment. In FIGS. 15 to 17, the white particles 13, the dispersant 6, the gap member 5, and so forth are omitted.

In the present exemplary embodiment, the case of a configuration where the display medium includes the negatively-charged magenta particles M, the positively-charged cyan particles C, and the negatively-charged yellow particles Y will be described, but the exemplary embodiment is not limited to this. It suffices for the color and the charge polarity of each particle to be appropriately set. Further, the values of the applied voltages in the description below are only examples and are not limited to these. It suffices for the values of the applied voltages to be appropriately set depending on the charge polarity of each particle, responsiveness, inter-electrode distance, and so forth.

As shown in FIG. 15(1), when the voltage application unit 30 applies a voltage of −Vm to the back-side electrode 4 with a pulse width needed to cause all of the magenta particles M on the back substrate 2 side to attach to the display substrate 1 side, all of the negatively-charged magenta particles M and all of the negatively-charged yellow particles Y migrate to the display substrate 1 side, and the positively-charged cyan particles C migrate to the back substrate 2 side, whereby the particles become attached to the entire surface of each substrate. Because of this, a mixed color of magenta and the yellow particles Y is displayed.

From the state in FIG. 15(1), as shown in FIG. 15(2), the voltage application unit 30 applies a voltage of +Vm to the back-side electrode 4 with a pulse width needed to cause all of the magenta particles M and the yellow particles Y on the display substrate 1 side to attach to the back substrate 2 side and to cause all of the cyan particles C on the back substrate 2 side to attach to the display substrate 1 side. When this happens, the positively-charged cyan particles C migrate to the display substrate 1 side, and the negatively-charged magenta particles M and yellow particles Y migrate to the back substrate 2 side, whereby the particles become attached to the entire surface of each substrate. Because of this, cyan is displayed.

From the state in FIG. 15(2), as shown in FIG. 15(3), the voltage application unit 30 applies a voltage of −Vc to the back-side electrode 4 with a pulse width needed to cause, of the cyan particles C on the display substrate 1 side, the cyan particles C in the particle quantity according to the gradation to be displayed to remain on the display substrate 1 side and to cause the other cyan particles C (the cyan particles C to be detached from the display substrate 1) to move to the back substrate 2 side. When this happens, the cyan particles C in the particle quantity to be detached in accordance with the gradation migrate to the back substrate 2 side and become attached to the back substrate 2 side. FIG. 15(3) shows cases where the cyan particles C moving to the back substrate 2 side become fewer in the order of the left side, the middle, and the right side. That is, the pulse width of the applied voltage becomes shorter in the order of the left side, the middle, and the right side in FIG. 15(3).

From the state in FIG. 15(3), as shown in FIG. 15(4), the voltage application unit 30 applies a voltage of +Vy to the back-side electrode 4 with a pulse width needed to cause, of the yellow particles Y on the display substrate 1 side, the yellow particles Y in the particle quantity according to the gradation to be displayed to remain on the display substrate 1 side and to cause the other yellow particles Y (the yellow particles M to be detached from the display substrate 1) to move to the back substrate 2 side. When this happens, the yellow particles Y in the particle quantity to be detached in accordance with the gradation migrate to the back substrate 2 side and become attached to the back substrate 2 side.

From the state in FIG. 16(1) (which is identical to FIG. 15(1)), as shown in FIG. 16(2), the voltage application unit 30 applies a voltage of +Vm to the back-side electrode 4 with a pulse width needed to cause, of the magenta particles M on the display substrate 1 side, the magenta particles M in the particle quantity according to the gradation to be displayed to remain on the display substrate 1 side and to cause the other magenta particles M (the magenta particles M to be detached from the display substrate 1) to move to the back substrate 2 side. When this happens, the magenta particles M in the particle quantity to be detached in accordance with the gradation and all of the yellow particles Y migrate to the back substrate 2 side and become attached to the back substrate 2 side, and the cyan particles C migrate to the display substrate 1 side and become attached to the display substrate 1.

Then, from the state in FIG. 16(2), as shown in FIG. 16(3), the voltage application unit 30 applies a voltage of −Vc to the back-side electrode 4 with a pulse width needed to cause, of the cyan particles C on the display substrate 1 side, the cyan particles C in the particle quantity according to the gradation to be displayed to remain on the display substrate 1 side and to cause the other cyan particles (the cyan particles C to be detached from the display substrate 1) to attach to the back substrate 2. When this happens, the cyan particles C in the particle quantity to be detached in accordance with the gradation migrate to the back substrate 2 side and become attached to the back substrate 2 side.

FIG. 16(3) shows cases where, like in FIG. 15(3), the cyan particles C moving to the back substrate 2 side become fewer in the order of the left side, the middle, and the right side. That is, the pulse width of the applied voltage becomes shorter in the order of the left side, the middle, and the right side in FIG. 16(3).

From the state in FIG. 16(3), as shown in FIG. 16(4), the voltage application unit 30 applies a voltage of +Vy to the back-side electrode 4 with a pulse width needed to cause, of the yellow particles Y on the display substrate 1 side, the yellow particles Y in the particle quantity according to the gradation to be displayed to remain on the display substrate 1 side and to cause the other yellow particles Y (the yellow particles Y to be detached from the display substrate 1) to move to the back substrate 2 side. When this happens, the yellow particles Y in the particle quantity to be detached in accordance with the gradation migrate to the back substrate 2 side and become attached to the back substrate 2 side.

FIG. 17 is the same as FIG. 16 except that the particle quantity of the magenta particles M moving to the back substrate 2 side when transitioning from FIGS. 17(1) to (2) is different.

Additionally, the point that, in the case of controlling the gradation of magenta and the gradation of cyan, the voltage application unit 30 applies to the back-side electrode 4 the first voltage for causing the particles to detach and then applies to the back-side electrode 4 the second voltage for causing the particles that have detached to sufficiently attach to the substrates is the same as in the first exemplary embodiment.

Further, in the ease of controlling the gradation of yellow, for example, the first voltage is a voltage that is higher than +Vy, which is the threshold voltage of the yellow particles Y, and the pulse width of the first voltage is a pulse width according to the gradation (density) of yellow to be displayed. The pulse width may also be the same and the CPU 40A may also control the gradation with the voltage value.

Further, the second voltage is a voltage having the same polarity as the first voltage and in which the absolute value of the voltage value is smaller than that of the first voltage. For example, in the case of performing gradation display of yellow, the second voltage is a voltage that is lower than +Vy, which is the threshold voltage of the yellow particles Y, and the pulse width of the second voltage is a pulse width by which the yellow particles Y that have detached from the display substrate 1 sufficiently attach to the back substrate 2.

Third Exemplary Embodiment

Next, a third exemplary embodiment of the present invention will be described. In the present exemplary embodiment, an embodiment in which a third voltage is applied in between the applications of the first voltage and the second voltage is described. The drive device 20 is the same as in the first exemplary embodiment, so description thereof will be omitted.

Figure 18:
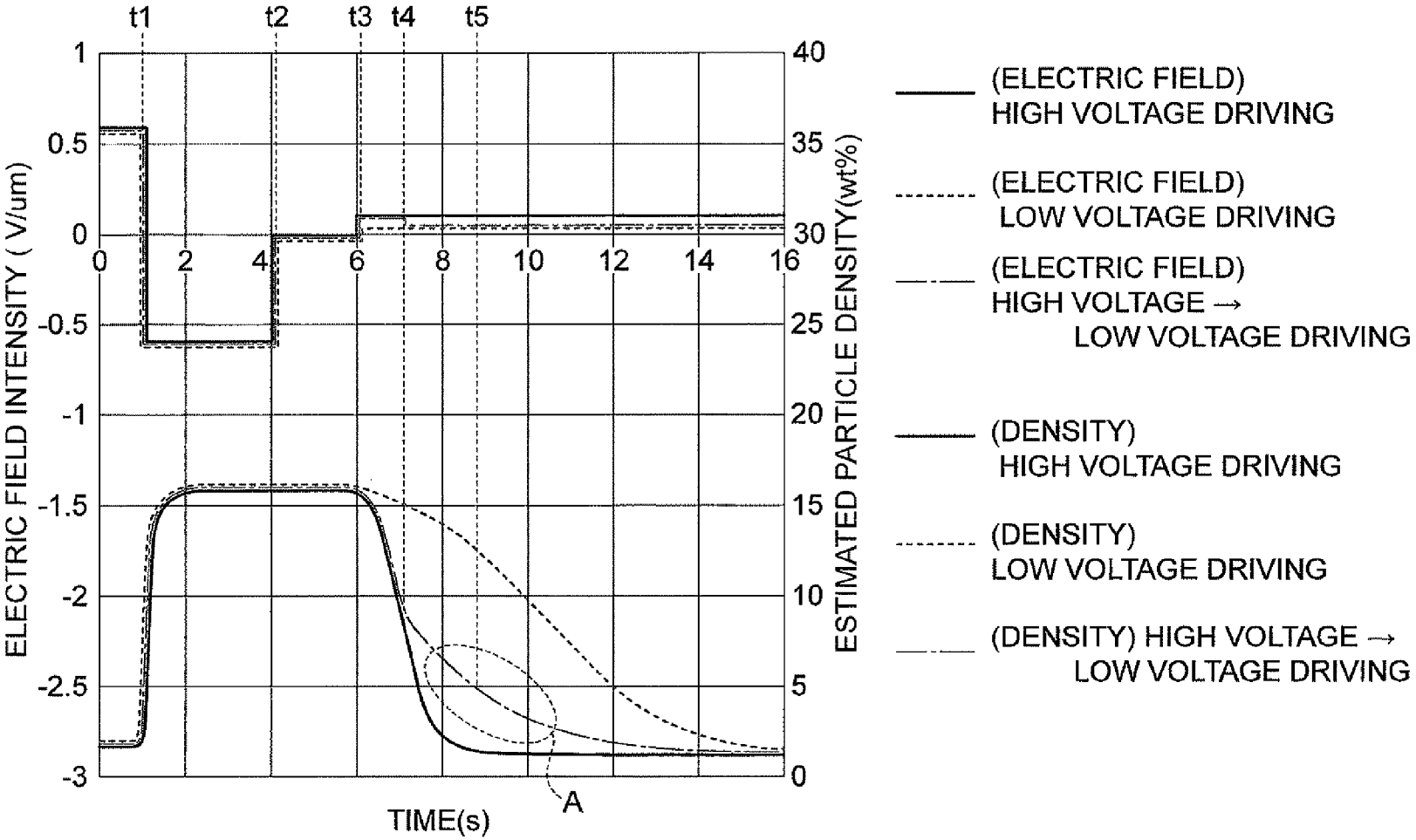
FIG. 18 is a diagram showing the relationship between the voltage application time and the electric field intensity and the relationship between the voltage application time and the estimated particle density.

First, the relationship between the particle responsiveness and the gradation controllability will be described in reference to FIG. 18. The upper side of FIG. 18 shows the relationship between the electric field intensity and time in which an electric field is formed between the substrates as a voltage is applied to the back-side electrode 4 and the display-side electrode 3 is grounded (0V). The lower side of FIG. 18 shows the measured result of the relationship between the estimated particle density of the negatively-charged particles and time.

As shown in FIG. 18, a negative reset voltage is applied to the back-side electrode 4 in the time between t1 to t2. Because of this, the negatively charged particles move to the display substrate 1 side and the density increases.

Moreover, FIG. 18 respectively shows, after the application of the reset voltage: the case when a positive high voltage is continuously applied from t3 (high voltage driving (solid line)); the case when a positive low voltage is continuously applied from t3 (low voltage driving (dashed line)); and the case when a positive high voltage is applied from t3 to t4 and a positive low voltage is applied after t4 (high voltage to low voltage driving (dashed-dotted line)).

As shown in FIG. 18, in the case of the high voltage driving, the density decreases quickly as the particles move quickly to the back substrate 2 side. It can be seen that particle responsiveness is high in this case. Further, in the case of the low voltage driving, the density decreases slowly as the particles move slowly to the back substrate 2 side. Therefore, although particle responsiveness is relatively low, since the density decreases slowly, the gradation controllability is high. Furthermore, the case of the high voltage to low voltage driving exhibits both of the respective characteristics of the high voltage driving and the low voltage driving. That is, the particle responsiveness is enhanced due to the high voltage being applied from t3 to t4, while the gradation controllability is enhanced, for example, in the region A surrounded by the dotted line in FIG. 18, due to the low-voltage being applied after t4.

Hence, in the present exemplary embodiment, by applying a third voltage in between the application of the first voltage and the application of the second voltage, the particle responsiveness and the gradation controllability are independently addressed.

Next, the control executed by the CPU 40A of the controller 40 will be described in reference to the flowchart shown in FIG. 19 as the action of the present exemplary embodiment.

Figure 10:
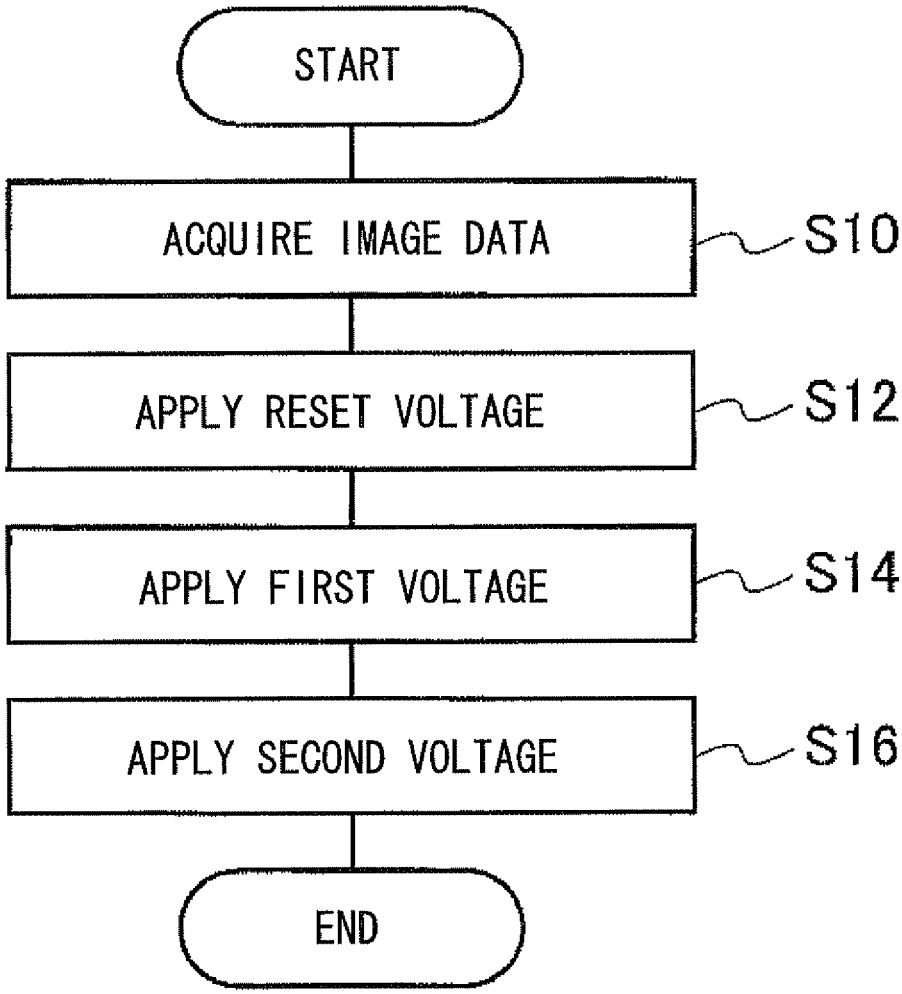
FIG. 10 is a flowchart of processing executed by a controller.
Figure 19:
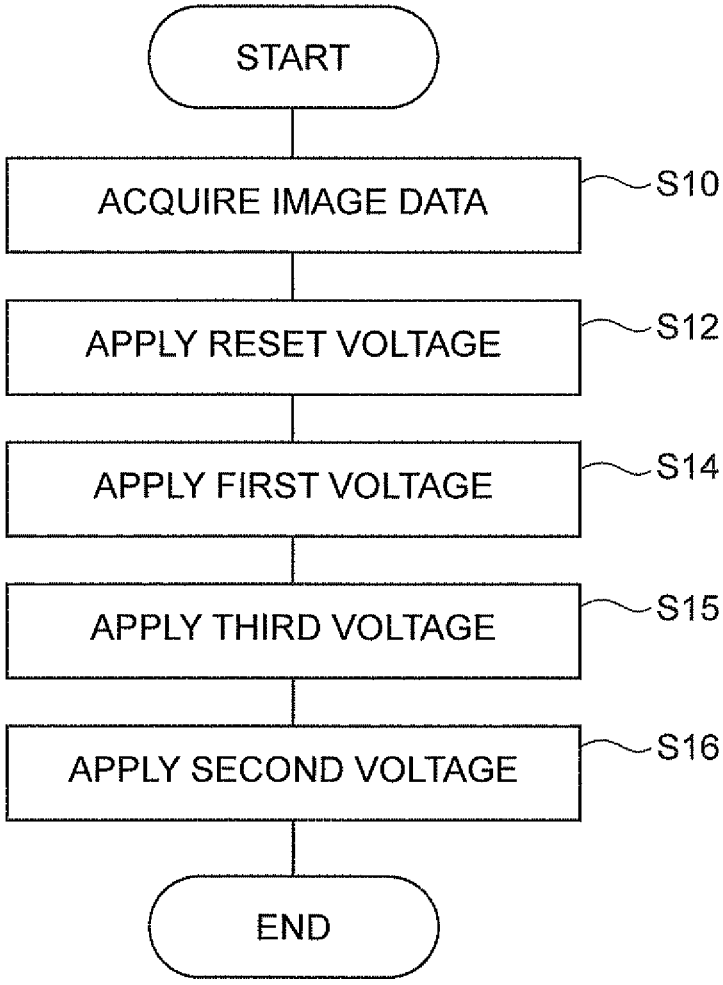
FIG. 19 is a flowchart of processing executed by a controller pertaining to the third exemplary embodiment.

As shown in FIG. 19, the processing shown in FIG. 19 differs from the processing shown in FIG. 10 described in the first exemplary embodiment in that step S15 is added.

First, in step S10, the CPU 40A acquires image data of an image to be displayed on the display device 100 from an unillustrated external device via the I/O 40E, for example.

Figure 20:
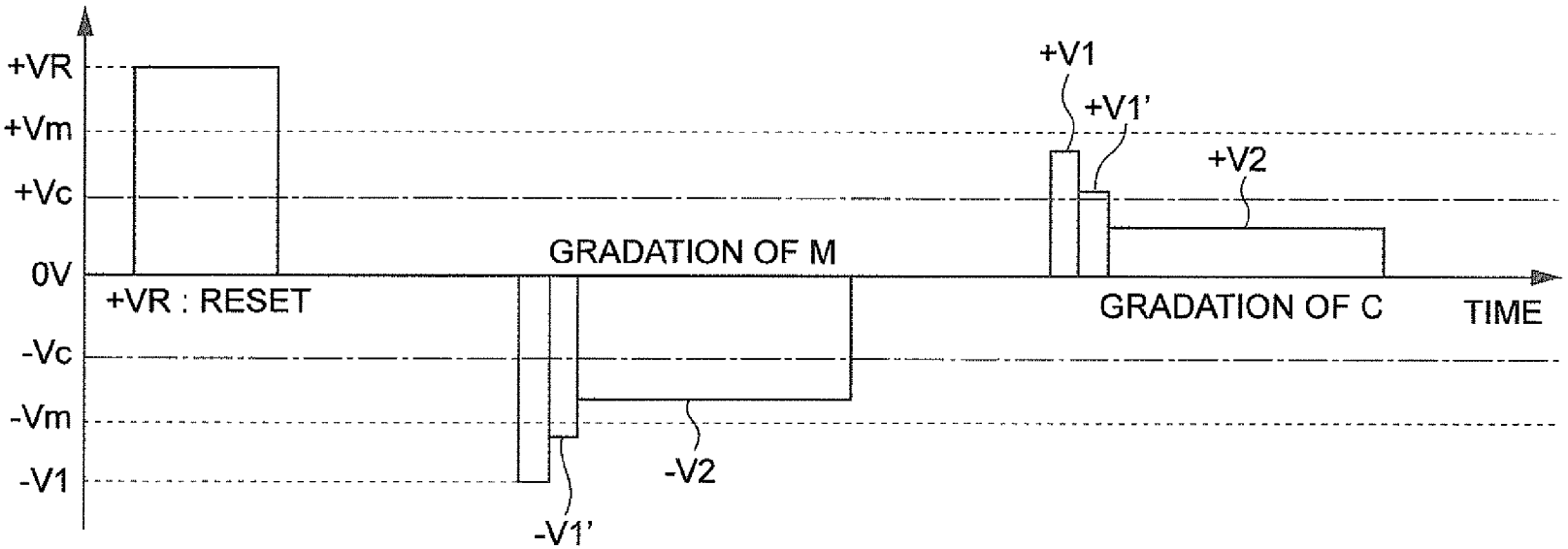
FIG. 20 is a diagram for describing a voltage application sequence when applying voltages in the display device pertaining to the third exemplary embodiment.

In step S12, the CPU 40A instructs the voltage application unit 30 to apply a reset voltage VR. As shown in FIG. 11, the reset voltage VR is a higher voltage than the threshold voltage +Vm of the magenta particles M. For this reason, as shown in FIG. 20(1), when the reset voltage VR is applied to the back-side electrode 4, all of the cyan particles C move and attach to the display substrate 1 side and all of the magenta particles M move and attach to the back substrate 2 side.

In step S14, the CPU 40A decides a first voltage to be applied to the back-side electrode 4 on the basis of the image data it has acquired and instructs the voltage application unit 30 to apply the first voltage. The voltage application unit 30 applies the first voltage instructed by the controller 40 to the back-side electrode 4.

The first voltage is a voltage according to the gradation of the color to be displayed on the display device 100. In the case of performing gradation display of magenta, for example, as shown in FIG. 20, the first voltage is a voltage −V1 that is lower than −Vm, which is the threshold voltage of the magenta particles M, and the pulse width of the first voltage is a pulse width according to the gradation (density) of magenta to be displayed.

This pulse width is decided according to the density characteristics such as that shown in FIG. 18. For example, if the density characteristics of the magenta particles M is as shown in FIG. 18 and the target density of the magenta particles M to be attained is 5 [wt %], the first voltage −V1 is applied for a duration of a pulse width t3 to t4, which is slightly shorter than the pulse width for which all of the magenta particles move according to the target density.

Figure 21:
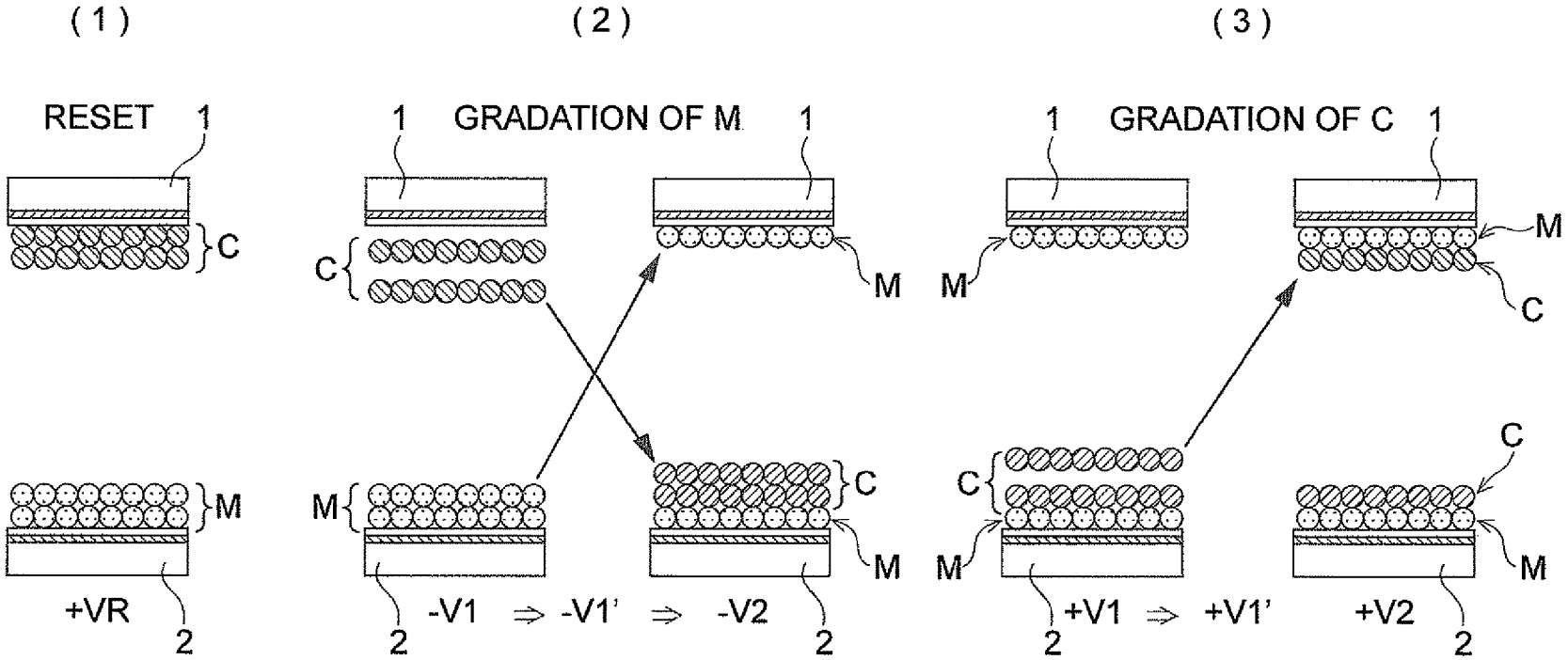
FIG. 21 is a schematic diagram showing the behavior of the migrating particles in response to voltage application in the display device pertaining to the third exemplary embodiment.

By applying the voltage −V1 to the back-side electrode 4, as shown in FIG. 21(2), the magenta particles M start moving from the back substrate 2 to the display substrate 1 side, and all of the cyan particles C move from the display substrate 1 to the back substrate 2 side.

In step S15, the CPU 40A applies a third voltage. The third voltage has a voltage value with a smaller absolute value than that of the first voltage applied in step S14 and a larger absolute value than the threshold voltage of the magenta particles M. Here, as shown in FIG. 20, the third voltage is a voltage −V1' that is higher than the first voltage −V1 and lower than −Vm, which is the threshold voltage of the magenta particles M, and the pulse width of the third voltage is a pulse width decided according to the gradation (density) of magenta to be displayed. For example, if the density characteristics of the magenta particles M is as shown in FIG. 18 and the target density of the magenta particles M to be attained is 5 [wt %], the third voltage is applied for the duration of the pulse width t4 to t5. Here, the voltage value of the third voltage may be set in the neighborhood of the threshold voltage of the magenta particles M. Moreover, from the particle responsiveness viewpoint, the pulse width of the third voltage may be set short.

In this way, by applying the first voltage in the beginning, the particles with quantity close to the quantity of magenta particles M at a target gradation are quickly moved, and thereafter, the third voltage is applied so that the magenta particles M are moved slowly until the target gradation is attained.

In step S16, the CPU 40A instructs the voltage application unit 30 to apply to the back-side electrode 4 a second voltage for causing the particles that have detached from one substrate to attach sufficiently to the other substrate. The voltage application unit 30 applies the second voltage instructed by the controller 40 to the back-side electrode 4.

This second voltage is a voltage having the same polarity as the first voltage and in which the absolute value of the voltage value is smaller than that of the first voltage. For example, in the case of performing gradation display of magenta, for example, as shown in FIG. 20, the second voltage is a voltage −V2 that is higher (has a smaller absolute value) than −Vm, which is the threshold voltage of the magenta particles M, and the pulse width of the second voltage is a pulse width by which the magenta particles M that have detached from the display substrate 1 sufficiently attach to the back substrate 2.

By applying the voltage −V2 to the back-side electrode 4 after applying the voltage −V1, as shown in FIG. 21(2), the magenta particles M that have detached from the back substrate 2 attach to the display substrate 1 without floating in the inter-substrate space.

In the case of performing gradation control of the cyan particles C from this state, as shown in FIG. 20, the voltage application unit 30 applies, as the first voltage, a voltage +V1 that is higher than the threshold voltage +Vc of the cyan particles C and is lower than the threshold voltage +Vm of the magenta particles to the back-side electrode 4 with a pulse width that is predetermined according to the gradation.

Thereafter, the voltage application unit 30 applies to the back-side electrode 4, as the third voltage, a voltage +V1' that is lower than the first voltage +V1 and higher than +Vc, which is the threshold voltage of the cyan particles C, with a pulse width that is predetermined according to the gradation.

The pulse widths of the first voltage and the third voltage are set in the same manners as in the case of the magenta particles M.

Thereafter, the voltage application unit 30 applies to the back-side electrode 4, as the second voltage, a voltage +V2 that is lower than +Vc. Because of this, as shown in FIG. 21(3), the cyan particles C in the particle quantity according to the applied voltage move from the back substrate 2 to the display substrate 1 side and attach to the display substrate 1 side.

Furthermore, the third voltage may be applied in between the application of the first voltage and the application of the second voltage in the case of driving a display medium having three types of electrophoretic particles as described in the second exemplary embodiment.

The display device pertaining to the present exemplary embodiment has been described above, but the present invention is not limited to the above exemplary embodiments.

For example, the particle group that does not migrate is not limited to a white particle group, and a black particle group, for example, may also be used.

What is claimed is:

1. A non-transitory computer readable storage medium storing a program to cause a computer to execute a driving method for a display medium that has a translucent display substrate, a back substrate that is placed opposing the display substrate across a gap, a dispersant that is sealed in an inter-substrate space between the display substrate and the back substrate, and plural types of particle groups with different colors and charge polarities that are dispersed in the dispersant and are sealed in the inter-substrate space so as to move in the inter-substrate space in response to an electric field formed in the inter-substrate space, the driving method comprising:

in a case of displaying a gradation of a color of a first particle group of the plural types of particle groups, applying to the inter-substrate space a first voltage according to the gradation of the color of the first particle group and which is a voltage equal to or greater than a threshold voltage needed to cause at least some of the particles of the first particle group to detach from the display substrate or the back substrate and thereafter applies a second voltage having a same electric field direction as having a same electric field direction of the first voltage and is lower than the threshold voltage, wherein the second voltage is a voltage whose voltage value is larger than that of a threshold voltage of a second particle group whose threshold voltage is next highest after the first particle group.

2. A driving method for a display medium that has a translucent display substrate, a back substrate that is placed opposing the display substrate across a gap, a dispersant that is sealed in an inter-substrate space between the display substrate and the back substrate, and plural types of particle groups with different colors and charge polarities that are dispersed in the dispersant and are sealed in the inter-substrate space so as to move in the inter-substrate space in response to an electric field formed in the inter-substrate space, comprising:

in a case of displaying a gradation of a color of a first particle group of the plural types of particle groups, applying to the inter-substrate space a first voltage according to the gradation of the color of the first particle group and which is a voltage equal to or greater than a threshold voltage needed to cause at least some of the particles of the first particle group to detach from the display substrate or the back substrate and thereafter applies a second voltage having a same electric field direction as an electric field direction of the first voltage and is lower than the threshold voltage, wherein the second voltage is a voltage whose voltage value is larger than that of a threshold voltage of a second particle group whose threshold voltage is next highest after the first particle group.

3. A display device comprising:

a display medium that has a translucent display substrate, a back substrate that is placed opposing the display substrate across a gap, a dispersant that is sealed in an inter-substrate space between the display substrate and the back substrate, and plural types of particle groups with different colors and charge polarities that are dispersed in the dispersant and are sealed in the inter-substrate space so as to move in the inter-substrate space in response to an electric field formed in the inter-substrate space; and a display medium drive device comprising:

a voltage application unit which, in a case of displaying a gradation of a color of a first particle group of the plural types of particle groups, applies to the inter-substrate space a first voltage according to the gradation of the color of the first particle group and which is a voltage equal to or greater than a threshold voltage needed to cause at least some of the particles of the first particle group to detach from the display substrate or the back substrate and thereafter applies a second voltage having a same electric field direction as an electric field direction of the first voltage and is lower than the threshold voltage, wherein the second voltage is a voltage whose voltage value is larger than that of a threshold voltage of a second particle group whose threshold voltage is next highest after the first particle group.

4. The display device according to claim 3 wherein the voltage application unit changes at least one of the application time and the voltage value of the second voltage in accordance with the gradation of the color of the first particle group.

5. The display device according to claim 3 wherein the application time of the first voltage is an amount of time in which all of the particles that have detached from the display substrate or the back substrate do not attach to the back substrate or the display substrate.

6. The display device according to claim 3 wherein the voltage application unit applies a third voltage whose voltage value is lower than the first voltage and higher than the threshold voltage.

* * * * *